US008875854B2

(12) United States Patent
Zuckerman

(10) Patent No.: US 8,875,854 B2
(45) Date of Patent: Nov. 4, 2014

(54) APPARATUS THAT INCLUDES A SUITCASE WITH INTEGRATED SUPPORT ARRANGEMENTS FOR CONVERSION TO A BED OR A CHAISE LOUNGE

(76) Inventor: Zeev Zuckerman, Great Neck, NY (US)

( * ) Notice: Subject to any disclaimer, the term of this patent is extended or adjusted under 35 U.S.C. 154(b) by 667 days.

(21) Appl. No.: 13/047,556

(22) Filed: Mar. 14, 2011

(65) Prior Publication Data

US 2012/0222931 A1 Sep. 6, 2012

Related U.S. Application Data

(60) Provisional application No. 61/449,453, filed on Mar. 4, 2011.

(51) Int. Cl.
*A45C 9/00* (2006.01)
*A45C 5/03* (2006.01)

(52) U.S. Cl.
CPC ... *A45C 5/03* (2013.01); *A45C 9/00* (2013.01); *A45C 2009/002* (2013.01)
USPC ..... 190/2; 224/156; 5/114; 5/116

(58) Field of Classification Search
CPC ..... A47B 85/00; A47C 17/82
USPC ..... 5/110, 114, 116; 224/155, 156; 190/1–13 R
See application file for complete search history.

(56) References Cited

U.S. PATENT DOCUMENTS

| | | | | |
|---|---|---|---|---|
| 1,005,709 A | | 10/1911 | Jackson | 190/2 |
| 1,120,480 A | | 12/1914 | Haskes | 190/2 |
| 1,428,642 A | * | 9/1922 | Lambie et al. | 5/119 |
| 1,733,916 A | * | 10/1929 | Spalding | 190/2 |
| 2,842,189 A | * | 7/1958 | Gratt | 297/227 |
| 3,223,300 A | | 12/1965 | Moore et al. | |
| 3,326,337 A | | 6/1967 | Bell | 108/36 |
| 3,516,523 A | | 6/1970 | Pemberton, Jr. | |
| 3,846,855 A | | 11/1974 | Peterson | 5/114 |
| 4,044,411 A | | 8/1977 | Peterson | 5/99 |
| 4,056,857 A | | 11/1977 | Quantz | 5/112 |
| 4,511,071 A | * | 4/1985 | Curran | 224/156 |
| 4,742,900 A | | 5/1988 | Boxhammer | 190/2 |
| 4,802,249 A | | 2/1989 | Bills | 5/420 |
| 4,856,627 A | | 8/1989 | Polatov | 190/11 |
| 4,883,206 A | | 11/1989 | Miller | 224/153 |
| 5,176,422 A | | 1/1993 | Canet | 297/17 |

(Continued)

FOREIGN PATENT DOCUMENTS

| | | |
|---|---|---|
| AU | 1992024422 | 4/1993 |
| FR | 329476 | 8/1903 |

(Continued)

OTHER PUBLICATIONS

Notification of Transmittal of the International Search Report and the Written Opinion of the International Searching Authority, or the Declaration dated Dec. 12, 2013 issued in corresponding PCT International Application No. PCT/US12/00124.

*Primary Examiner* — Tri Mai

(74) *Attorney, Agent, or Firm* — Ostrolenk Faber LLP

(57) ABSTRACT

An apparatus that includes a suitcase and integrated support arrangements that are transformable from an extended state to provide support for a person to lie down and a stored state for ease of transport.

17 Claims, 31 Drawing Sheets

(56) References Cited

U.S. PATENT DOCUMENTS

| | | | | |
|---|---|---|---|---|
| 5,265,289 | A | 11/1993 | Swiger et al. | 5/111 |
| 1,525,572 | A | 2/1995 | Dodd | |
| 5,551,558 | A | 9/1996 | Bureau | 206/223 |
| 5,611,414 | A | 3/1997 | Walker | 190/2 |
| 5,957,349 | A | 9/1999 | Krulik | 224/155 |
| 6,174,026 | B1 * | 1/2001 | Wise | 297/120 |
| 6,655,736 | B1 * | 12/2003 | Arenas | 297/229 |
| 6,687,928 | B1 | 2/2004 | Wilson | 5/99.1 |
| 6,851,139 | B2 | 2/2005 | Arason et al. | 5/159.1 |
| 7,058,997 | B1 | 6/2006 | Klinger | 5/413 R |
| 7,097,017 | B1 | 8/2006 | LaCrosse et al. | 190/8 |
| 7,451,709 | B2 * | 11/2008 | Swartfager et al. | 108/14 |
| 7,574,758 | B2 | 8/2009 | Arason et al. | 5/159.1 |
| 7,717,309 | B1 * | 5/2010 | Lehmberg | 224/154 |
| 2002/0074251 | A1 | 6/2002 | Hershberg | 206/315.1 |
| 2008/0135366 | A1 | 6/2008 | Katz et al. | 190/18 A |
| 2010/0175960 | A1 | 7/2010 | Moskowitz et al. | 190/11 |
| 2010/0252589 | A1 * | 10/2010 | Popescu | 224/155 |
| 2011/0056788 | A1 | 3/2011 | Jackson | 190/2 |
| 2011/0108381 | A1 | 5/2011 | Gibson | 190/11 |

FOREIGN PATENT DOCUMENTS

| | | | |
|---|---|---|---|
| FR | 2834431 | * | 1/2002 |
| GB | 216920 | | 6/1924 |
| GB | 382587 | | 10/1932 |
| GB | 1 443 664 | | 7/1976 |
| GB | 2 181 640 | | 4/1987 |
| GB | 2244912 | | 12/1991 |
| WO | WO 2008/092863 | | 8/2008 |

* cited by examiner

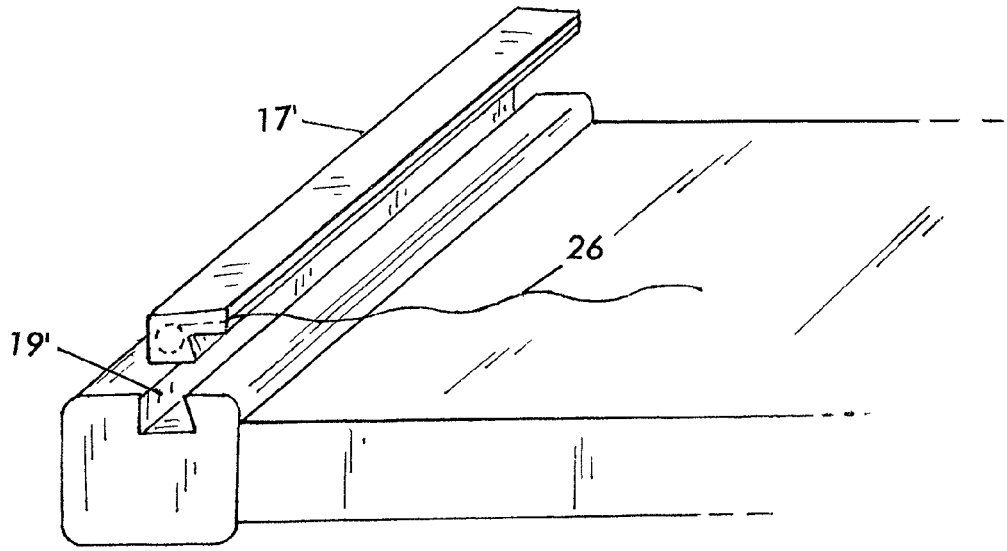
FIG. 1D'
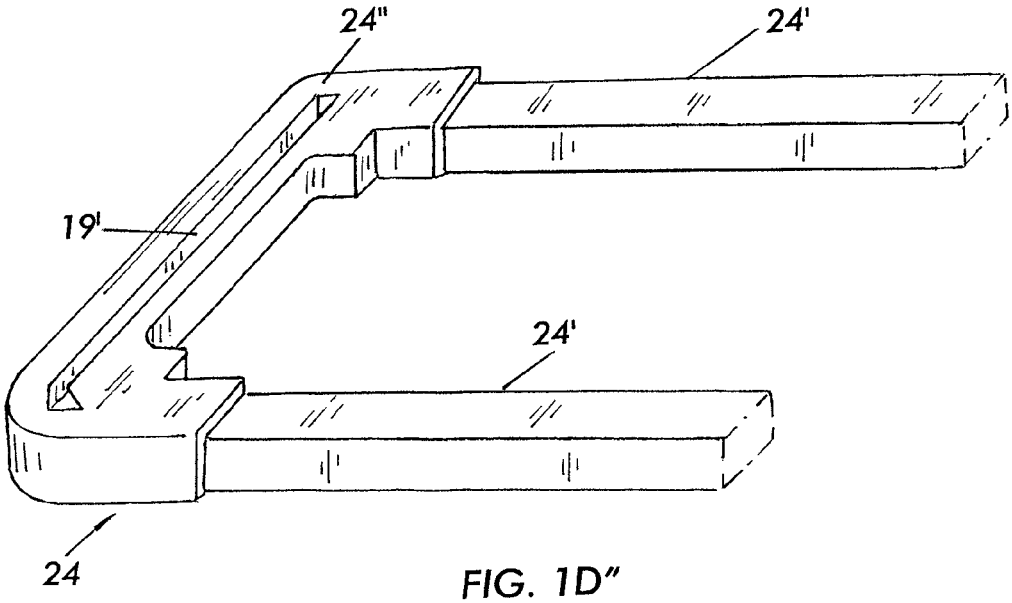
FIG. 1D"

20
24"
26
24'
16
30
12'
30
26
24'
22
24"

24"
24'
24
24'
14
16

14
24"
24
24'
12'
44
16

12"
44
14
12'
44

APPARATUS THAT INCLUDES A SUITCASE WITH INTEGRATED SUPPORT ARRANGEMENTS FOR CONVERSION TO A BED OR A CHAISE LOUNGE

CROSS REFERENCE TO RELATED APPLICATION

This application is based on and claims benefit of U.S. Provisional Application Ser. No. 61/449,453, filed Mar. 4, 2011, entitled A Suitcase Arrangement, to which a claim of priority is hereby made and the disclosure of which is incorporated by reference.

FIELD OF THE INVENTION

The present invention relates to travel accessories and more particularly to an apparatus that can be selectively converted to an elongated support surface for use as a bed or the like support.

OBJECTIVE

An objective of the present invention is to realize a suitcase or the like that can be converted into a bed or chaise lounge.

BACKGROUND

It is well known that a traveler may become stranded in an airport terminal or the like place for an extended period of time due to unexpected delays in the availability of transport arrangements. In such circumstances, the traveler may need to stay at the airport until alternative arrangements are made. While waiting, a traveler may need to rest. Airports and other like facilities typically provide very little space suitable for rest.

U.S. Pat. No. 4,742,900 discloses a suitcase having foldable portions that can be arranged in an extended state to provide a support surface that can be used as a bed. The foldable portions discloses by U.S. Pat. No. 4,742,900 must traverse the storage space of the suitcase when stored or deployed for use. Thus, a traveler must remove the stored items in order to use the suitcase as a bed or the like resting apparatus, which is inconvenient and burdensome.

U.S. Pat. No. 1,005,709 discloses a trunk having an arrangement that can be transformed into a bed. This arrangement includes a mattress stored in a storage facility that is integrated with the trunk, the storage facility including two hinged support bodies that function to support a portion of the weight of the mattress when the apparatus is deployed for use. The purpose of the mattress is to provide a level surface to support a person in the lying position. Otherwise, the platform realized when the support bodies are deployed includes a substantially recessed surface in the mid section thereof which would not allow a traveler to comfortably use the same as a bed without the mattress.

U.S. Pat. No. 4,856,627 discloses a briefcase with extendable leaves that can be used as extra work space in an extended state. The extra support surfaces provided by the leaves are recessed below the top surface of the suit case. This arrangement does not provide a surface that could provide proper support for a person in a lying state.

U.S. Pat. No. 3,516,523 discloses a suitcase having extendable leaves to define a surface that can be used as an ironing board. The ironing board so defined is as narrow as the narrowest side of the suitcase. Moreover, the arrangement is not configured to provide proper support for a person in a lying state.

SUMMARY OF THE INVENTION

An object of the present invention is to provide a suitcase that includes integrated support mechanisms that can be extended to define a platform suitable for use as a bed or a chaise lounge by a user. The platform so defined may include support regions that can support at least the upper section (above the chest) and the mid section (between the chest and below the hips) of a user's body and preferably also the bottom section (below the hips and down to the ankles) of the user.

A suitcase according to the present invention includes at least one support surface which in an extended state includes a region that intercepts a plane coinciding with an exterior region of a top panel or a base panel of the suitcase that can support a mid section of a user in a lying position. The intercepting region thus can support a portion of the upper section of the user in the lying position.

Another object of the present invention is to provide a support mechanism that can be changed from an extended state to a stored state without interfering with the storage space, whereby the user is not forced to remove the items in the storage space in order to deploy the supports for use as a bed or a chaise lounge.

An apparatus according to the present invention, therefore, may include a suitcase having a base panel, a top panel spaced from the base panel, and a plurality of side panels extending from the base panel around a storage space between the top panel and the base panel for receiving items, the base panel and the top panels having a width and a length, and each side panel having a width, which is shorter than the length and the width of the base and top panels, a first support arrangement residing at one side of the suitcase selectively transformable from an extended state to a stored state and from a stored state to an extended state without interfering with the storage space, wherein in the extended state the support arrangement includes a support surface with a region that is intercepted by a horizontal plane coinciding and coplanar with an exterior region of one of the base panel and the top panel. Preferably, an apparatus according to the present invention includes a second support residing at another side of the suitcase opposite the one side and is selectively transformable from an extended state to a stored state and from a stored state to an extended state without interfering with the storage space. Preferably, each support arrangement is wider than the width of the side panels.

In a preferred embodiment, in the extended state, each support arrangement includes a support surface with a region that is intercepted by a plane coinciding with an exterior region of one of the base panel and the top panel.

In one embodiment, each the support arrangement comprises a frame that includes two spaced elongated legs that are connected to one another by an elongated connector and a compliant body that is detachably connectable to the connector. The embodiment may further include a first longitudinally extending support and a second longitudinally extending support, each having two opposite open ends leading into a hollow interior, wherein each longitudinally extending support receives in the interior thereof a respective leg of a frame from one end thereof. The legs of the first support may be receivable in the interior of the legs of the second support in one variation of this embodiment. This embodiment may further include a roller mechanism associated with each compliant body, each roller mechanism including a roller body, wherein the compliant body is rolled around the roller body in the stored state.

In another embodiment, the support surfaces overlap one another and one of the base panel and the top panel in the stored state. The support arrangements may rotate to move from the stored state to the extended state, or may slide when moved from the stored state to the extended state.

An apparatus according to the present invention is:

great for resting after a long day at the airport, bus station, or train;

perfect for crowded airports, with no seats available;

usable as an infant changing table;

a secure way of guarding your valuables while you rest.

Other features and advantages of the present invention will become apparent from the following description of the invention which refers to the accompanying drawings.

BRIEF DESCRIPTION OF THE FIGURES

FIG. 1C' illustrates a connector portion of a frame section of a support in a suitcase according to the present invention with the integrated stabilizer thereof partially deployed.

FIG. 1D' illustrates another arrangement for coupling a sheet to a frame portion of a support.

FIG. 1D" illustrates a frame portion configured for coupling to a hook-shaped coupling to realize the arrangement illustrated by FIG. 1D'.

FIG 1D'" illustrates an arrangement for coupling a sheet to a frame portion.

DETAILED DESCRIPTION

Unless otherwise indicated like numerals identify like features in the disclosed embodiments.

The figures attached to this description are not drawn to scale.

In this application, ' and " are not to be understood to be designations for feet or inches or any other unit of measurement.

Figure 1A:
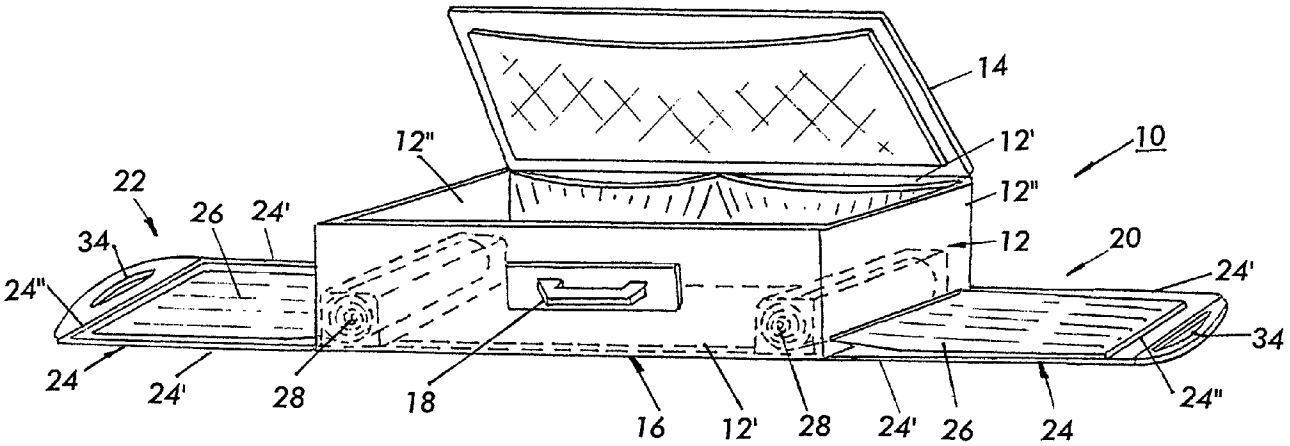
FIG. 1A shows a first perspective view of a suitcase according to an embodiment of the present invention.
Figure 1D:
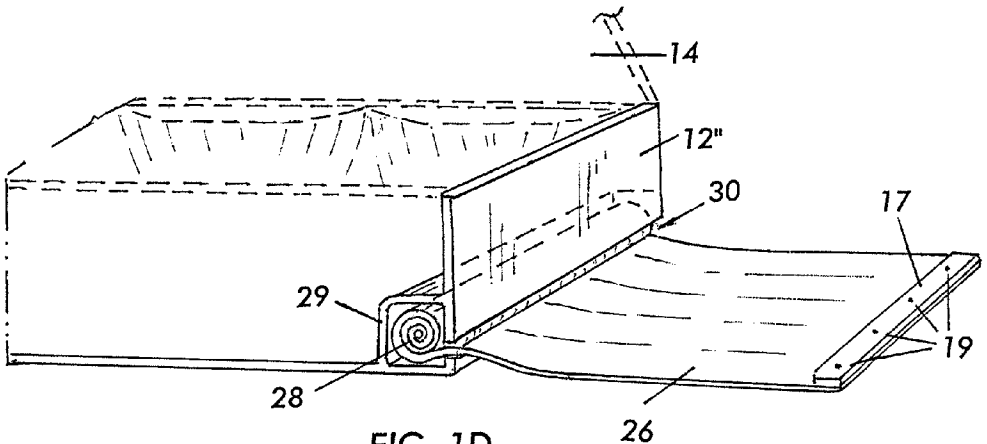
FIG. 1D illustrates a roller for use with a support mechanism of a suitcase according to the present invention.
Figure 1B:
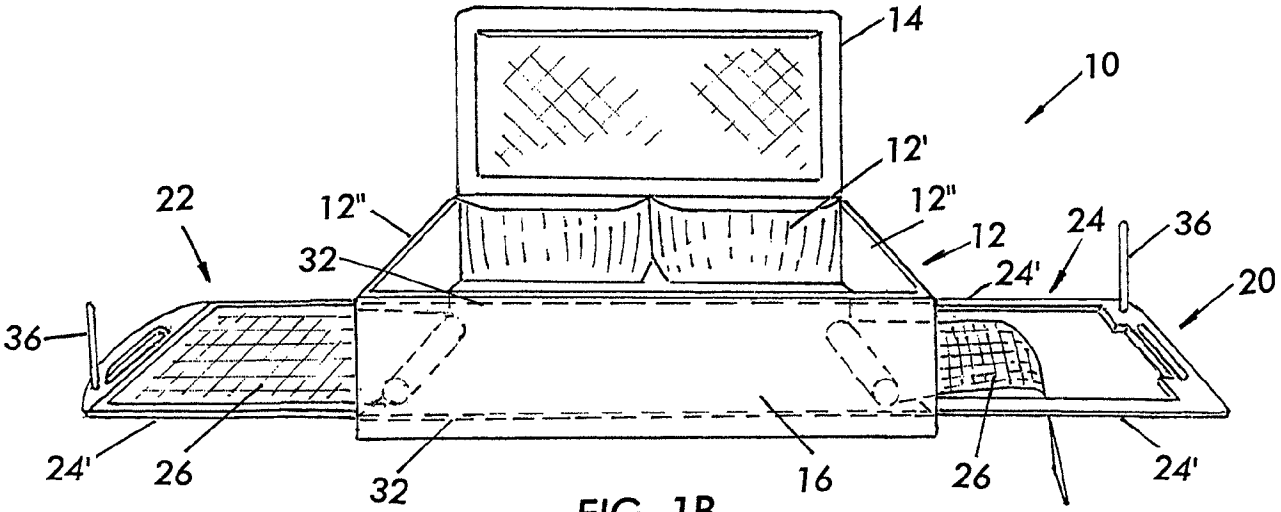
FIG. 1B shows another perspective view of a suitcase according to the embodiment illustrated by FIG. 1A.

FIGS. 1A and 1B illustrate a perspective view of a first embodiment of a suitcase 10 in an apparatus according to the present invention. Suitcase 10 includes a container section 12. Container section 12 is integrated with a top panel 14 which may be hingedly coupled to container section 12 so that it may be selectively moved to allow access to an interior storage space of container 12. In a typical configuration, container section 12 may have a cubical configuration with two opposing and generally parallel long panels 12' and two opposing and generally parallel short panels 12" each being directly or indirectly attached to a common base panel 16 to define the storage space of container section 12. The storage space so defined receives transportable, travel-related items such as clothing and other personal items. Top panel 14 is connected (e.g., via a living hinge or the like) to one of the panels 12', 12". In the embodiment illustrated, top panel 14 is connected to a long panel 12', although it could also be connected to a short panel 12" without deviating from the scope of the present invention. A top panel 14 so connected can be selectively rotated about its hinged connection to allow access to the storage space of container section 12. Furthermore, top panel 14 can be coupled to panels 12', 12" to enclose the storage space of container section 12. A handle 18 or the like may be coupled to an exterior surface of one or more of panels 12', 12".

According to one aspect of the present invention, two support arrangements 20, 22 are integrated with container section 12. In the first embodiment of the present invention, each support arrangement 20, 22 includes a frame section 24, which is a relatively rigid body (e.g. a steel or aluminum tube), and a foldable or rollable sheet 26 of fabric, plastic, or the like compliant material that is detachably attachable to frame section 24.

In the first embodiment, the sheet 26 may be rolled around a spring loaded roller 28, which may be an elongated, cylindrical rod, tube or the like body. A suitable spring loaded roller 28 may be a roller that is used for spring loaded shades, which are well known. The spring loading of roller 28 allows roller 28 to rotate under the force of a loaded spring so that, upon detachment from frame 24, sheet 26 is rolled up by roller 28. Note that the spring is loaded when sheet 26 is drawn out to be attached to a frame 24 much like a roller mechanism of a spring loaded shade.

Alternatively, sheet 26 may be folded into a compartment.

In the first embodiment, roller mechanism 28 resides adjacent the storage space of container section 12. A cover 29 or the like may be used to separate a roller 28 from the items inside the storage space of container section 12 as illustrated by FIG. 1D.

In the first embodiment, each sheet 26 is accessible and retractable through a slot 30 defined between an edge of base panel 16 and an edge of a short panel 12" as illustrated by FIG. 1D. It should be noted that the free edge of each sheet 16 may include an integrated bar portion 17. Bar portion 17 includes a plurality of spaced through holes 19 therein. Each hole 19 can be used to couple a sheet 16 to a portion of a frame 24 using a hook 15 (see FIG.1D'") or the like fastener whereby sheet 16 can be readily attached to or detached from a frame section 24.

According to another aspect of the present invention, each frame section 24 includes two side legs 24' and an elongated connector 24" that is connected at each end thereof to an end of a respective side leg 24'. Each frame 24 may be a single piece of elongated material (e.g. a tube or a rod) which is bent to have two legs 24' and a connector section 24". Alternatively, a frame 24 may be made with two elongated bodies serving as legs 24' which are connected at respective ends thereof to ends of another elongated body serving as a connector 24". A sheet 16 in the first embodiment may be coupled to a connector 24" by hooks or other appropriate means as described above. Optionally, at least one of the connector 24" may include a handle section 34.

Each side leg 24' is longitudinally aligned and receivable inside the interior space of a longitudinally extending, elongated support 32, which may be a tube or the like body. According to one aspect of the present invention, two parallel supports 32 are provided positioned opposite one another, each extending along a bottom edge of a long panel 12'. Each support 32 is open at both opposing ends thereof. Each leg 24' is receivable inside a support 32 from an open end of the support 32 whereby legs 24' can be inserted into and retracted from supports 32 in a telescopic manner.

Figure 1C:
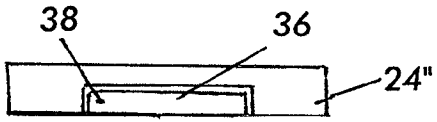
FIG. 1C illustrates a connector portion of a frame section of a support in a suitcase according to the present invention.
Figure 1C:
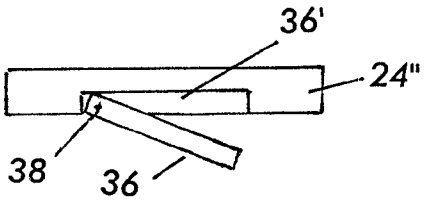
Figure 1D:
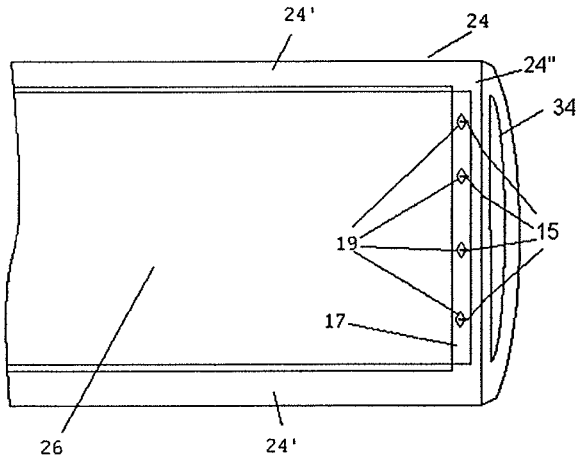

Furthermore, according to another aspect of the present invention, a stabilizer 36 may be pivotably attached (e.g., with a pivot pin 38 or the like) at one end thereof to at least one connector 24", but preferably both connectors 24" as illustrated by FIG. 1B. Stabilizer 36 may be a rigid body (e.g., a tube or the like body). Stabilizer 36 may be pivotably moved into a position so that it may be axially aligned generally transverse to the direction of the longitudinal axis of a leg 24'. FIG. 1C illustrates a stabilizer 36 in a stored state. As illustrated, a recess 36' or the like feature may be provided to receive the stabilizer therein for storage. FIG. 1C' illustrates a stabilizer 36 in a partially deployed state.

Figure 1E:
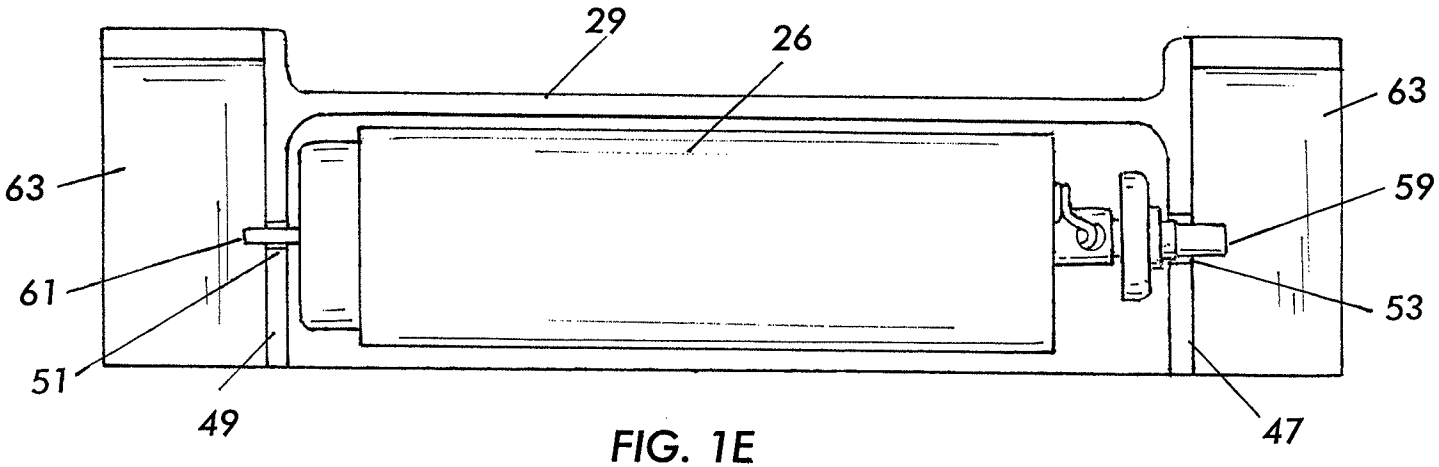
FIG. 1E illustrates a roller mechanism for use with a suitcase according to the present invention.

Referring to FIG. 1E, cover 29 includes two integrated brackets 47, 49 to support the mechanism that supports roller 28.

Figure 1G:
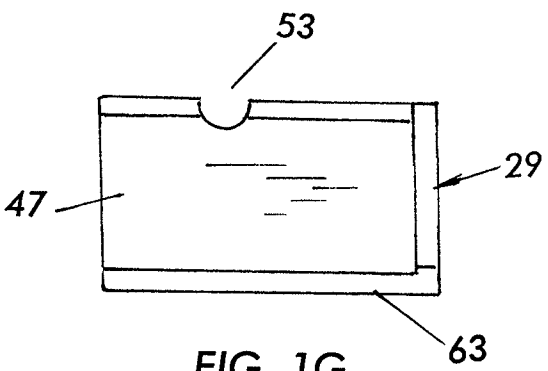
FIG. 1G illustrates a second bracket portion for receiving another end of the supporting rod of the roller mechanism.
Figure 1F:
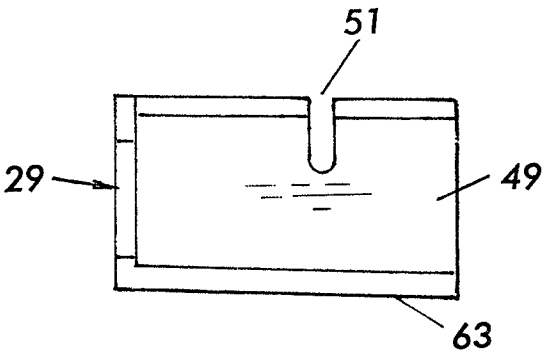
FIG. 1F illustrates a first bracket portion for receiving an end of a supporting rod of the roller mechanism.
Figure 1H:
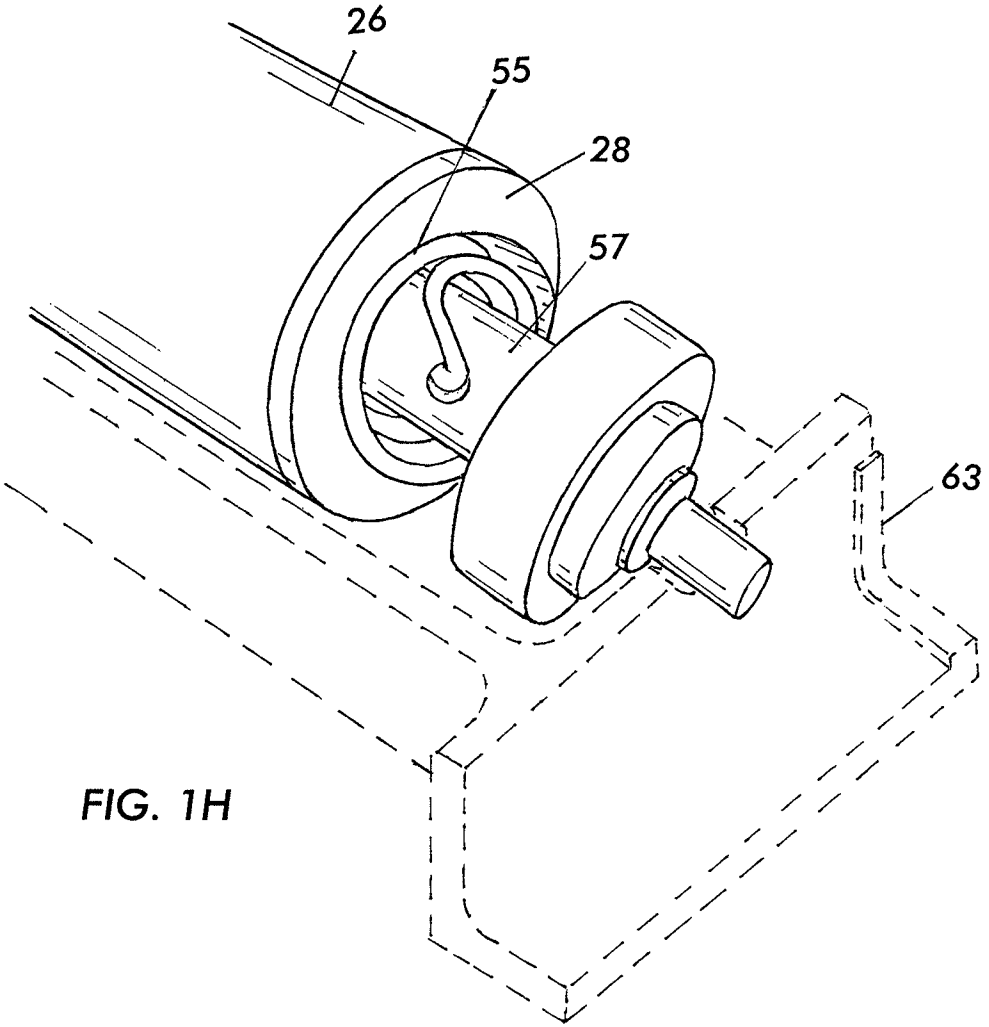
FIG. 1H illustrates the spring loading arrangement of the roller mechanism.
Figure 1I:
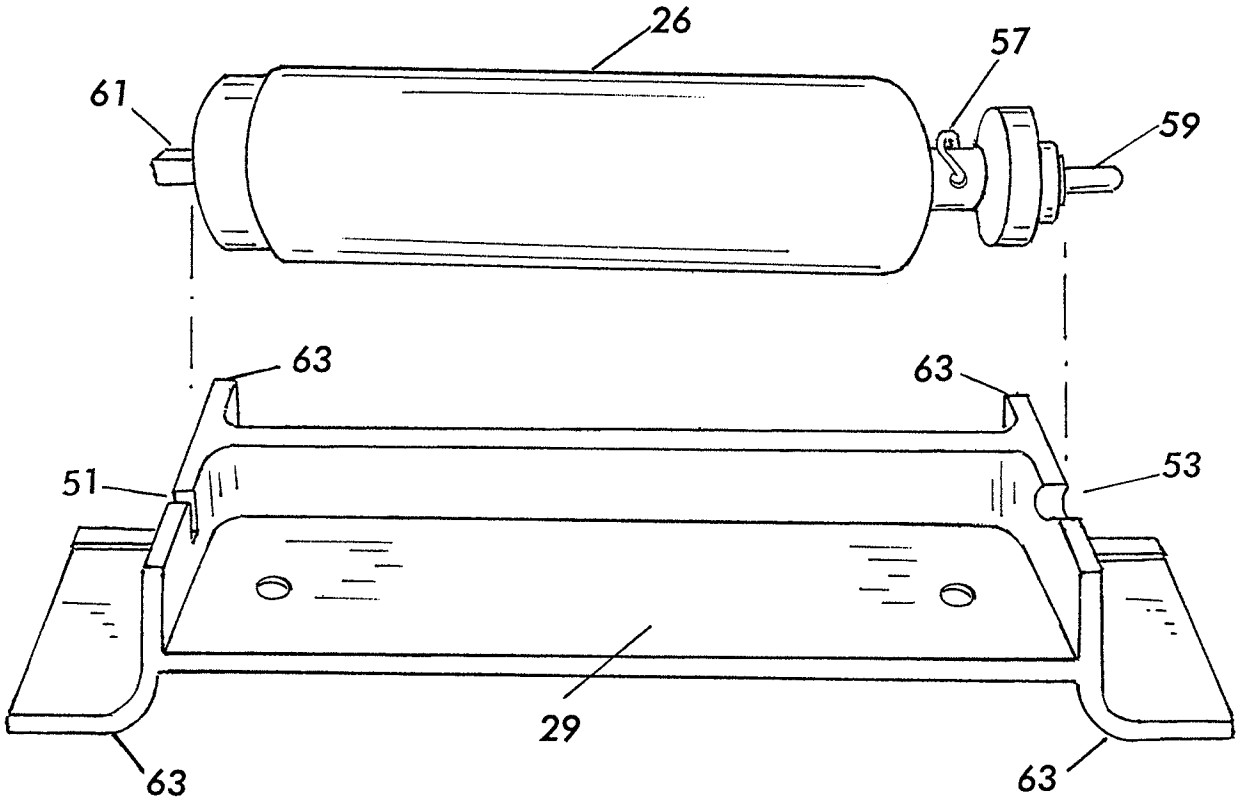
FIG. 1I illustrates the roller mechanism in a disassembled state.

Referring to FIG. 1F, one bracket 47 includes an elongated slot 51 formed in the body thereof. Another bracket 49 includes a concave recess 53 formed in the body thereof as illustrated by FIG. 1G. Referring to FIG. 1H, roller 28 is coupled by a spring 55 to a supporting rod 57. Supporting rod 57 is disposed inside roller 28 and includes a first end 59 (see FIG. 1I) which is cylindrical in shape and received in recess 53, and another end 61 (see FIG. 1I) which is flat and receivable in slot 51. FIG. 1E illustrates this arrangement. Sheet 26 is rolled around roller 28 and coupled at a terminal edge thereof to the body of roller 28. When sheet 26 is withdrawn it causes roller 28 to rotate about its longitudinal axis. Since supporting rod 57 is fixed to brackets 47, 49, it does not rotate with roller 28. Consequently, the rotation of roller 28 stores energy in spring 55, which is coupled to roller 28 and supporting rod 57. The energy so stored can rotate roller 28 automatically, which would in turn allow sheet 26 to be automatically rolled around roller 28. This mechanism has been employed for the automatic withdrawal of shades.

Figure 1J:
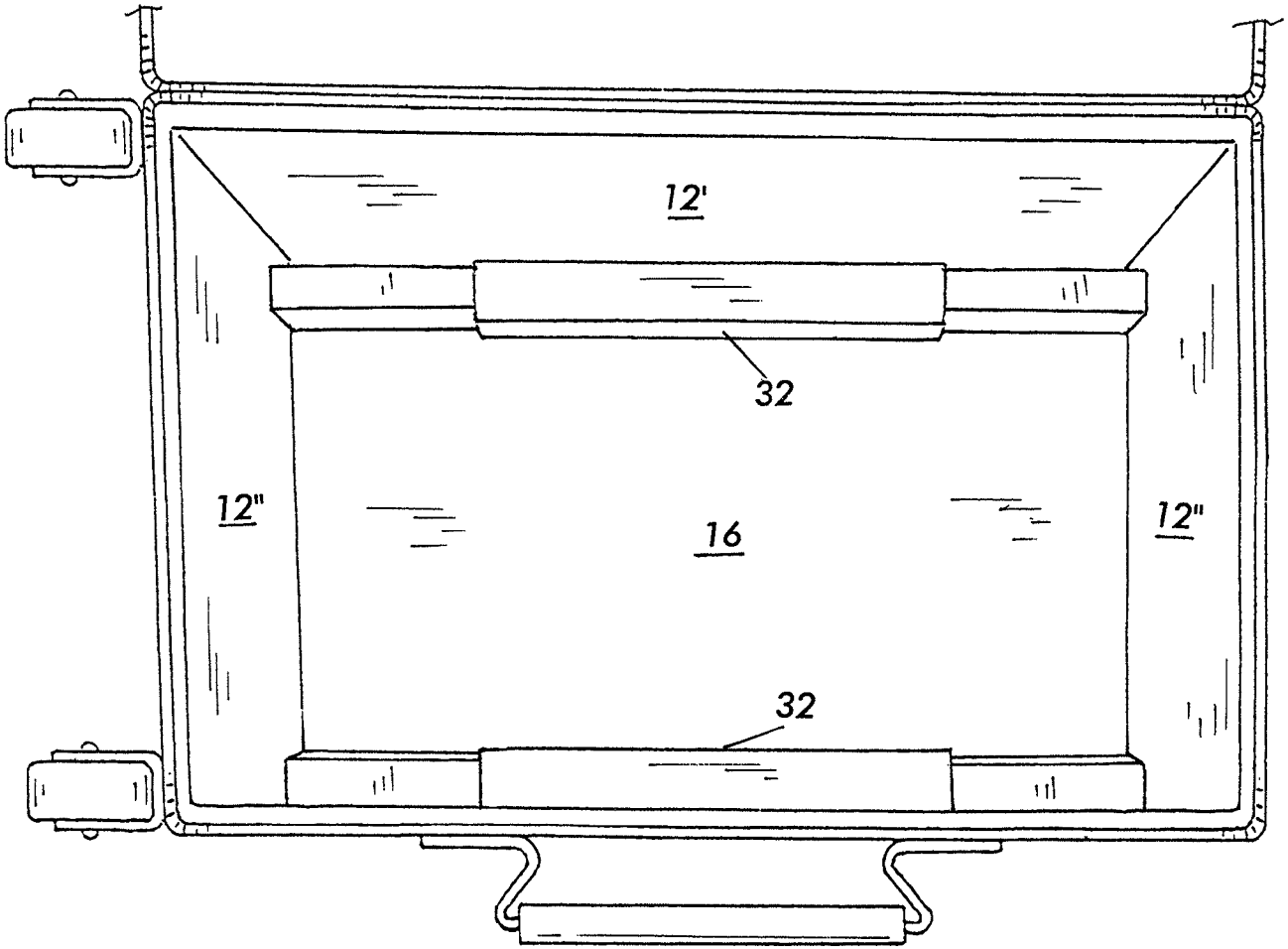
FIG. 1J shows the interior of the container section of a suitcase according to the present invention without the rolling mechanisms.
Figure 1K:
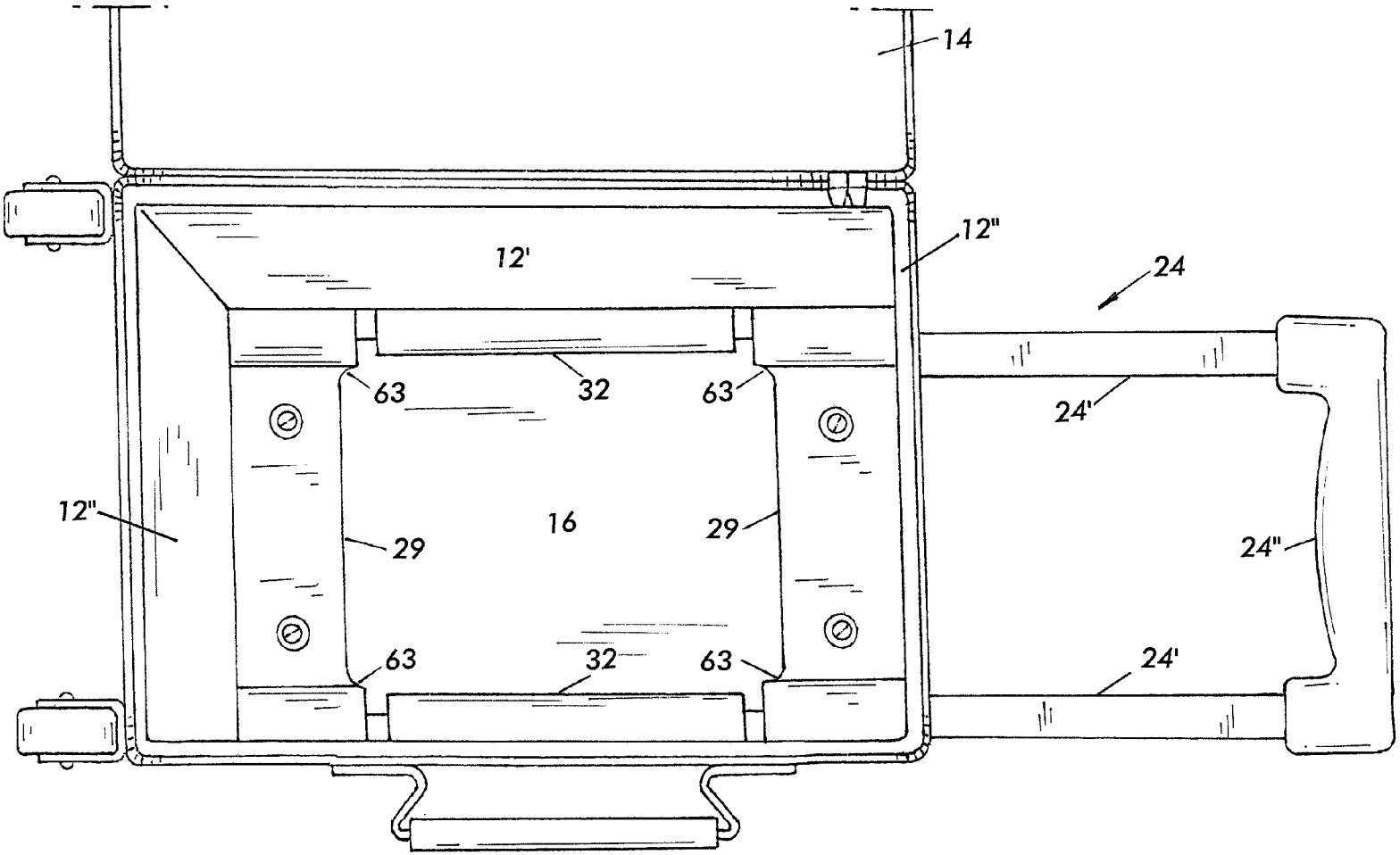
FIG. 1K shows the interior of the container section of a suitcase according to the present invention with two rolling mechanisms installed in place, and one frame drawn out for illustrative purposes.

FIG. 1J shows the interior space of container section 12 without roller mechanisms. FIG. 1K shows the interior of container section 12 with the roller mechanism installed therein, and one frame withdrawn. Note that each cover 29 may include two integrated portions 63 the purpose of which is to extend over side legs 24'. As will be appreciated each cover 29 will separate the roller mechanisms from the storage space of container section 12 in order to prevent items stored therein from interfering with the operation of the roller mechanism.

Figure 1N:
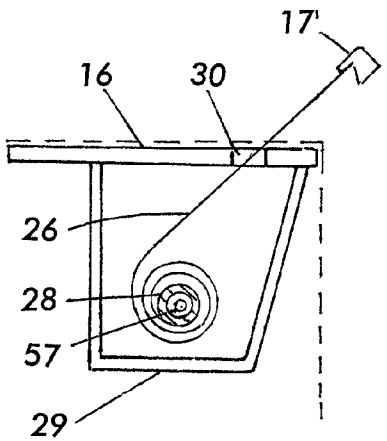
FIGS. 1M and 1N illustrate the arrangement of the roller mechanisms in a suitcase according to the embodiment disclosed by FIG. 1L.
Figure 1M:
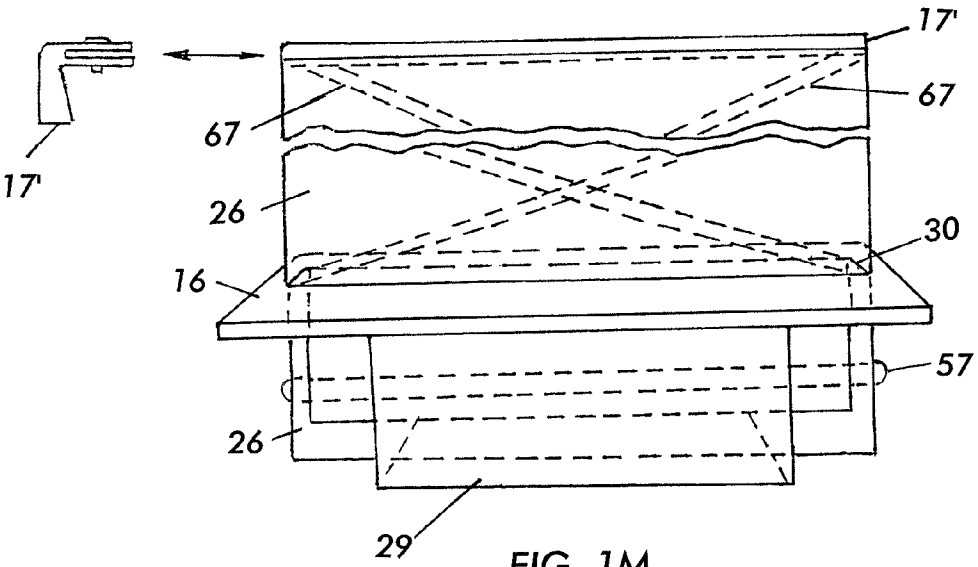
Figure 1L:
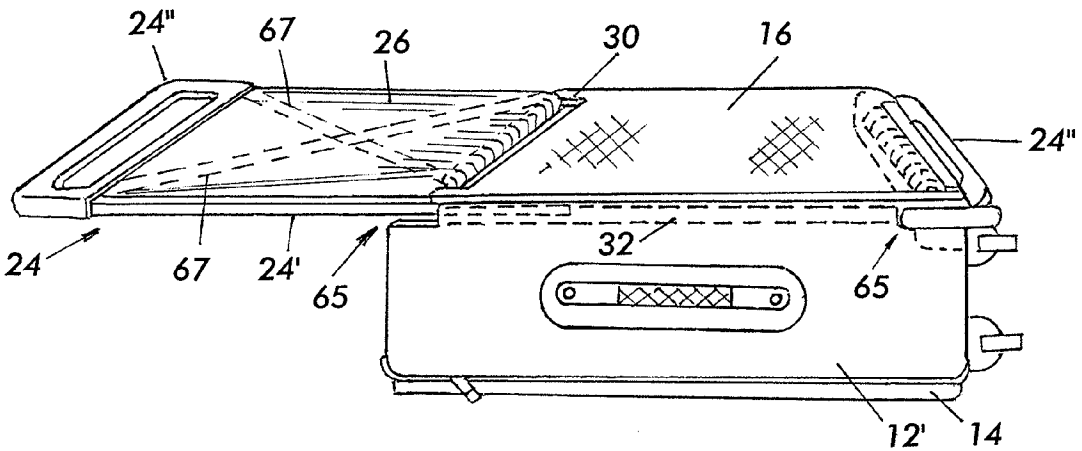
FIG. 1L illustrates a perspective view of another embodiment of the present invention with one support arrangement in an extended state and one support arrangement in a stored state.
Figures 1O, 1P, 1Q, 1R:
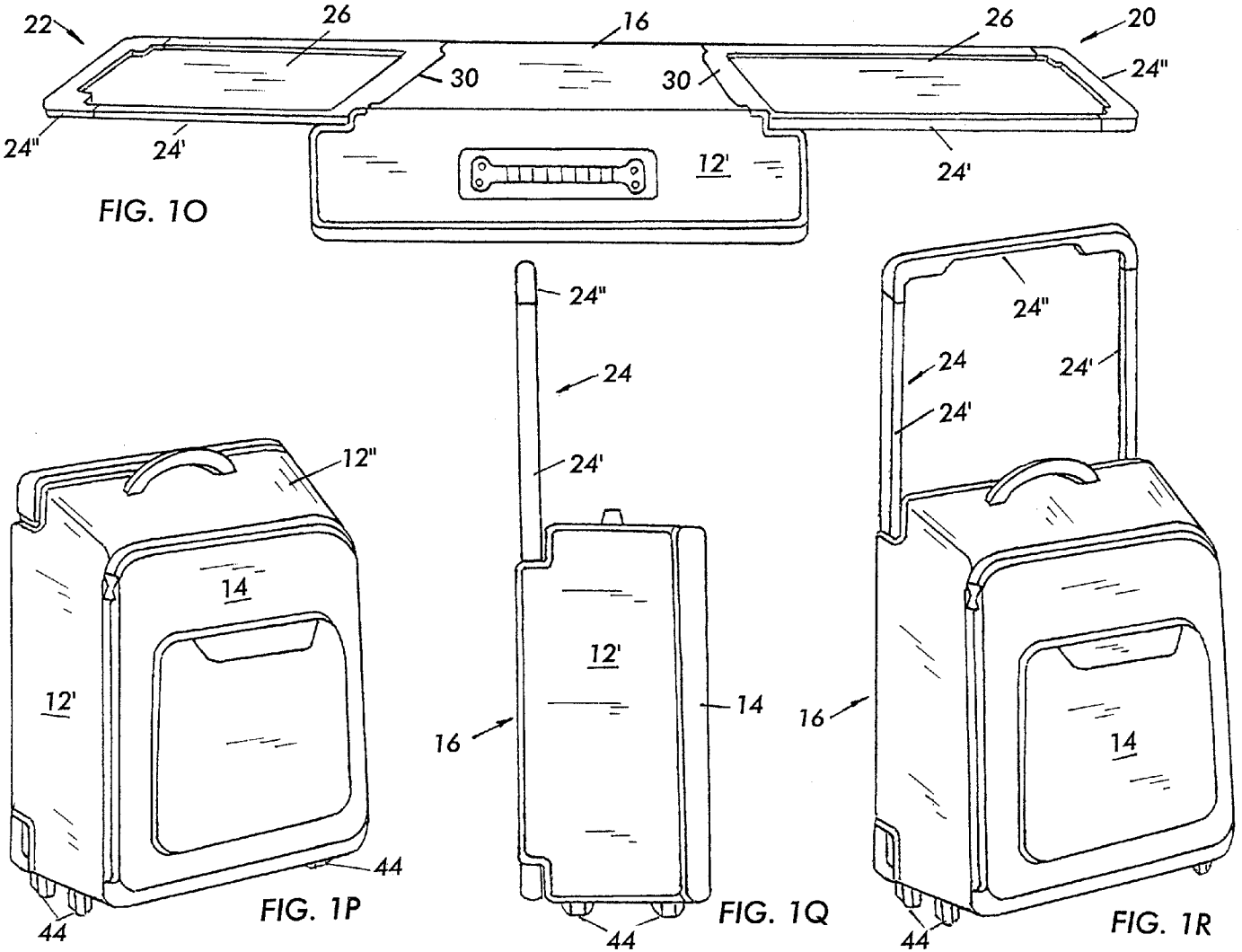
FIG. 1O illustrates a perspective view of the embodiment illustrated in FIG. 1L with both support arrangements in an extended state.
FIG. 1P illustrates a perspective view of the embodiment of FIG. 1L with both support arrangements in a stored state.
FIG. 1Q illustrates a side plan view of the embodiment of FIG. 1L with a frame thereof in an extended state.
FIG. 1R illustrates a perspective view of the embodiment shown in FIG. 1L with a frame thereof in an extended state and ready for use as a handle for dragging the suitcase.
Figure 1S:
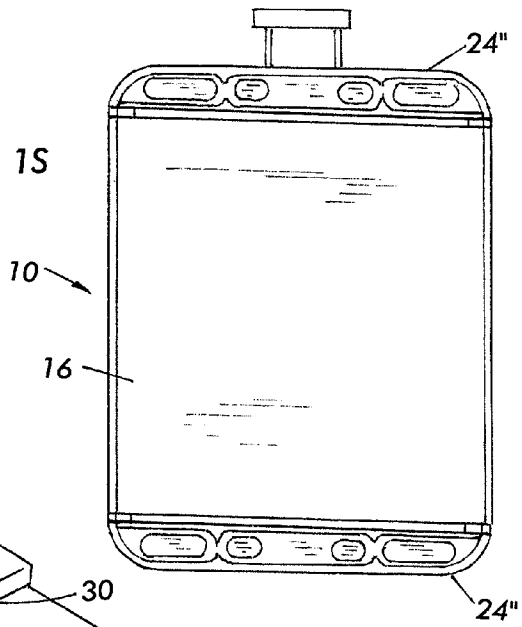
FIG. 1S illustrates a back plan view of an apparatus according to the embodiment illustrated by FIG. 1L with the support arrangements in a stored state.
Figure 1T:
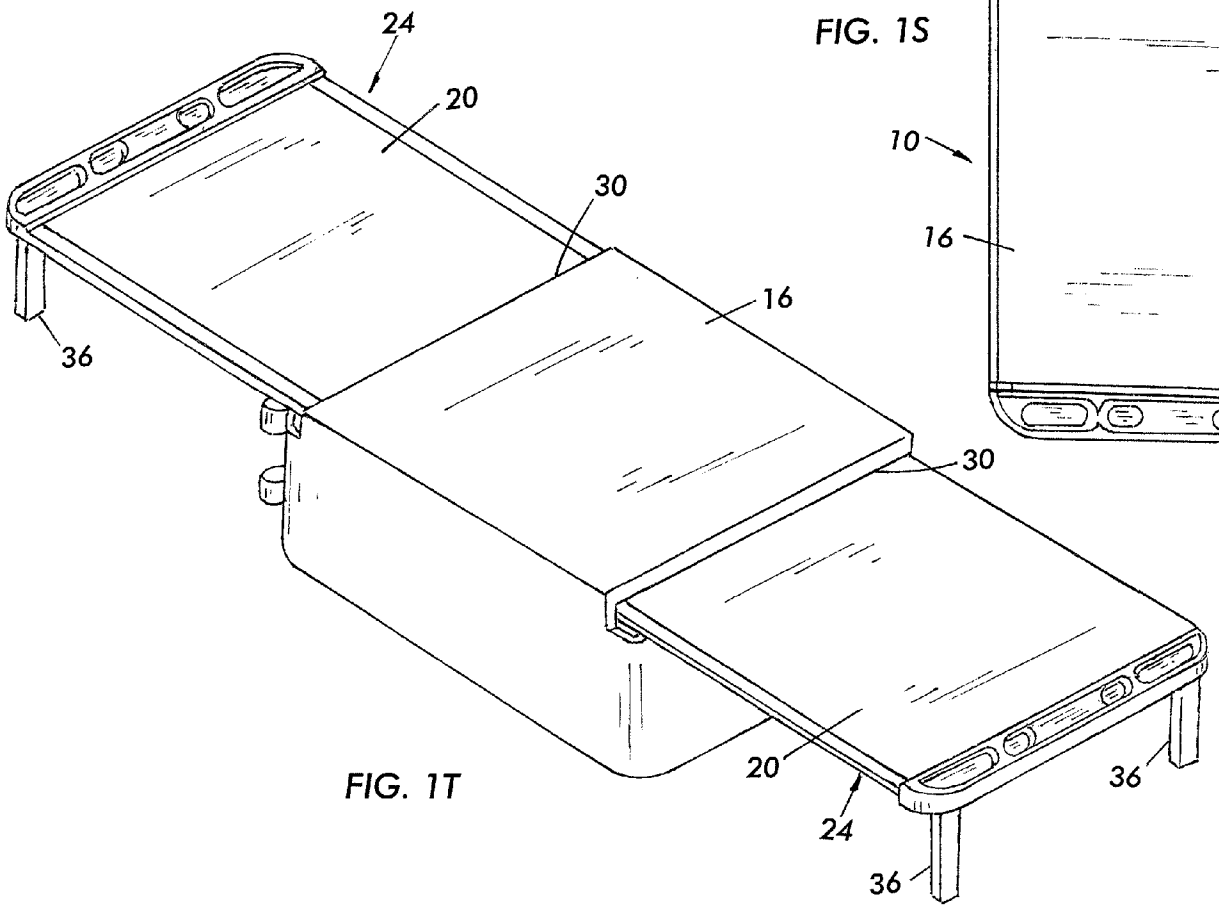
FIG. 1T illustrates a perspective view of an apparatus according to the embodiment illustrated by FIG. 1L with the support arrangements in an extended state.

Referring to FIG. 1L, in another embodiment of the present invention, a slot 30 for feeding a sheet 26 from the interior of container section 12 to the exterior thereof is defined in base panel 16 instead of between a side panel 12" and base panel 16 as shown in FIG. 1D. In this embodiment, recesses 65 are defined in the exterior of container section 12. Recesses 65 are defined deep enough to at least partially receive connector sections 24" to achieve a more compact arrangement when side legs 24' are stored in supports 32. FIGS. 1O-1T illustrate different views of the embodiment illustrated by FIG. 1L. Thus, FIG. 1O shows the embodiment with both support arrangements 20,22 in an extended state. FIG. 1P illustrates the support arrangements in a stored state. FIG. 1Q shows a side plan view of the embodiment of FIG. 1L with one frame 24 thereof in an extended state. FIG. 1R illustrates a perspective view of the embodiment of FIG. 1L with a frame 24 thereof in an extended state and ready for use as a handle. FIG. 1S illustrates a back plan view while FIG. 1T illustrates a perspective of the apparatus with the support arrangements 20, 22 in an extended state. Note that FIG. 1T discloses two spaced stabilizers 36 integrated with each support arrangement 20, 22.

According to another aspect of the present invention, flexible reinforcing ribs 67 may be integrated with sheet 26 to improve the mechanical integrity thereof. FIGS. 1M and 1N further illustrate the arrangement described above.

Referring to FIG. 1D', bar portion 17 may be replaced with an elongated latch 17'. Elongated latch 17' includes a hook-shaped profile (cross-section). Hook-shaped latch 17' is receivable in an elongated slot 19' having a cross-section with a shape complementary to the shape of the cross-section of latch 17'. Slot 19' may be defined in connector 24" portion of each frame as illustrated by FIG. 1D". When a latch 17' is received in a slot 19', sheet 26 that is attached to latch 17' is coupled to a frame 24. To disassemble sheet 26, latch 17' is withdrawn from slot 19'. In addition to what has been shown and described, other mechanisms such as hooks or the like may also be used to couple a sheet 26 to an associated frame 24.

To use a suitcase 10 according to the present invention, a user can pull out one or both frames 24 from supports 32, pull out a sheet 26 associated with a frame 24 and attach the same to its associated frame 24 by attachment to a connector section 24" thereof. Then, suitcase 10 is positioned so that top panel 14 makes contact with the floor or the like external support surface. Consequently, base panel 16 of container section 12 is positioned between two support sections 20, 22, and therefore, can support most of the weight of an individual. Note that a suitcase 10 according to the first embodiment, can be converted into a bed without having to open top panel 14. Moreover, advantageously, if base panel 16 is made of a flexible, compliant material, such as fabric, the soft items (e.g., clothing etc.) can serve as a soft support (e.g., a cushion). Thus, in an arrangement according to the present invention, most of the weight of the user can be supported by container section 12 and the contents thereof, which may allow for construction of frames 24 and sheets 26 with lighter weight materials.

An apparatus according to the present invention advantageously embodies the following features. These features are present in every embodiment disclosed herein.

Support arrangements 20,22 can be deployed and stored without having any part thereof interfering (i.e. crossing or passing through) the storage space of container section 12. Thus, a user can conveniently make use of the support mechanisms of the present invention without the need to remove the items contained in the storage space of container section 12.

Moreover, when deployed (i.e. extended state) at least one support arrangement 20,22 (and preferably both support arrangements 20,22) will include a region on a support surface thereof (i.e. a portion on a sheet 26) that intercepts a horizontal plane coinciding and coplanar with a region of the exterior surface of base panel 16 (or top panel 14). Consequently, the mid section of a person can be supported by a region coinciding and coplanar with the exterior surface of base panel 16 (or top panel 14 if support arrangements 20,22 are located at a side nearest to top panel 14) while the upper section of the person can be supported by the region on a support surface that intercepts a horizontal plane coinciding and coplanar with the exterior surface of base panel 16, whereby the body of the person lying down is not forced into an arched position. Rather, the body of the person lying down will find a support position for its mid section on a horizontal plane that coincides and is coplanar with a region on the exterior surface of base panel 16 and another support position for its upper section on a surface of sheet 26. The distance between these two support positions can be determined statistically for a commercial embodiment of the present invention. Preferably, this distance will not be less than two feet. Note that the same support configuration can be provided to support the mid section and the lower section of a person lying down, whereby the body of a person lying down can be supported by three support points on a horizontal plane that coincides and is coplanar with a region on base panel 16, is intercepted by a support surface of a sheet 26 in one support arrangement 20,22, and intercepted by a support surface of a sheet 26 of the other support arrangement 20,22. The appropriate distances between the support points can be determined statistically.

As is apparent from the figures, the support arrangements are wider than the width of side panels 12',12" to provide adequate surface area to support the width of a human body lying down. This width (i.e. the distance between legs 24' in each frame) can also be calculated statistically. Preferably, the width is not less than eighteen inches.

Figure 2A:
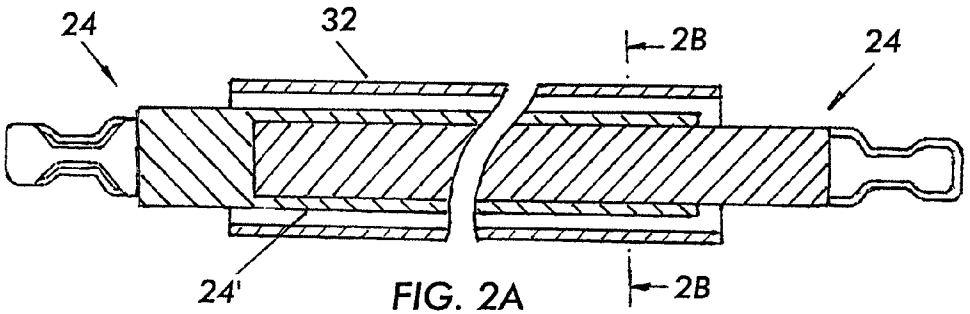
FIG. 2A illustrates a side plan view of a telescopic support mechanism for use with a suitcase according to the present invention.
Figure 2B:
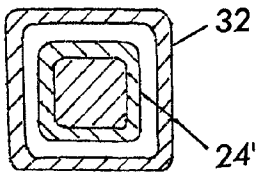
FIG. 2B shows a cross-sectional view along line 2B-2B in FIG. 2A, viewed in the direction of the arrows.
Figure 2C:
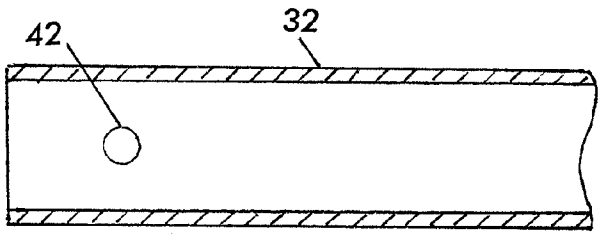
FIG. 2C shows a top plan view of a portion of the telescopic support mechanism.
Figure 2D:
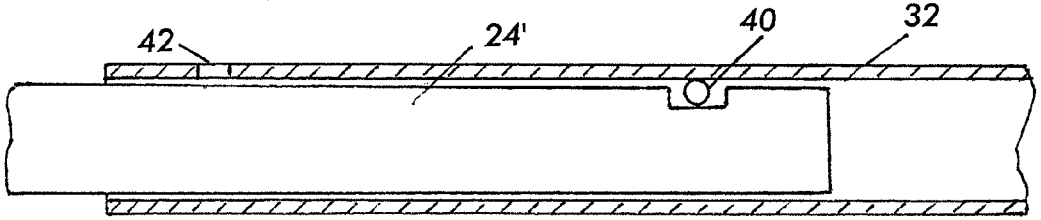
FIG. 2D shows a side plan view of a portion of the telescopic support mechanism in one state of operation.
Figure 2F:
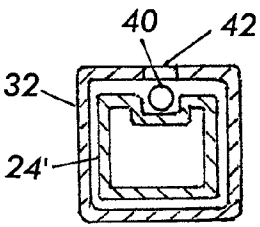
FIG. 2F shows a cross-sectional view along line 2F-2F viewed in the direction of the arrows.
Figure 2E:
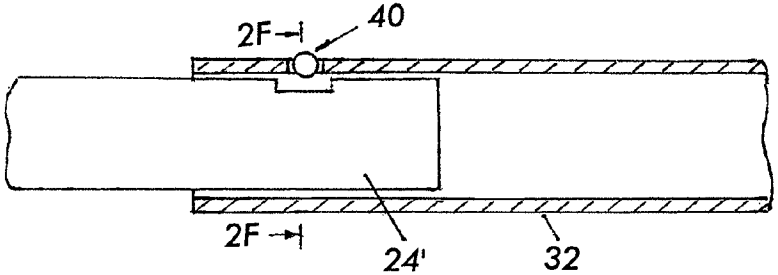
FIG. 2E shows a side plan view of a portion of the telescopic support mechanism in another state of operation.

In one embodiment of the present invention, each side legs 24' of one frame 24 is hollow, open at one end, and capable of receiving in the interior thereof a side leg 24' of the other frame 24. FIGS. 2A and 2B illustrate one of the two side legs 24' of frame 24. The other of the two side legs 24' would be arranged in the same manner. As illustrated, one side leg 24' (side leg 24' illustrated on the left) is a hollow tube which receives in the interior thereof another side leg 24' (side leg 24' on the right). Thus, one side leg 24' is receivable into and retractable from the interior of another side leg 24'. Note that, both side legs 24' are received in the interior of support 32 in a telescopic manner. Thus, the interior of support 32 is wide enough for both side legs 24'. Note that while in this embodiment one leg 24' is received inside another leg 24', such a configuration is not necessary. Each pair of legs 24' can be telescopically received inside a respective common support 32 and arranged side by side or one under the other.

Referring now to FIGS. 2C-2F, in one embodiment, a side leg 24' can be stopped from being further withdrawn by a catch mechanism. The catch mechanism includes a spring-loaded catch 40, which may be a spring-loaded ball or the like, residing at a location near the free end of at least one side leg 24'. A corresponding opening 42 can be provided in support 32. Opening 42 and catch 40 are positioned to register with one another when a side leg 24' is withdrawn from support 32 far enough for the two features to coincide. Thus, catch 40 is received inside opening 42 whereby it abuts the interior wall of opening 42 to restrict leg 24' from being further withdrawn. To insert leg 24' into the interior of support 32, catch 40 may be manually pressed down so that it no longer restricts the ability of leg 24' to be inserted into support 32.

Figure 2G:
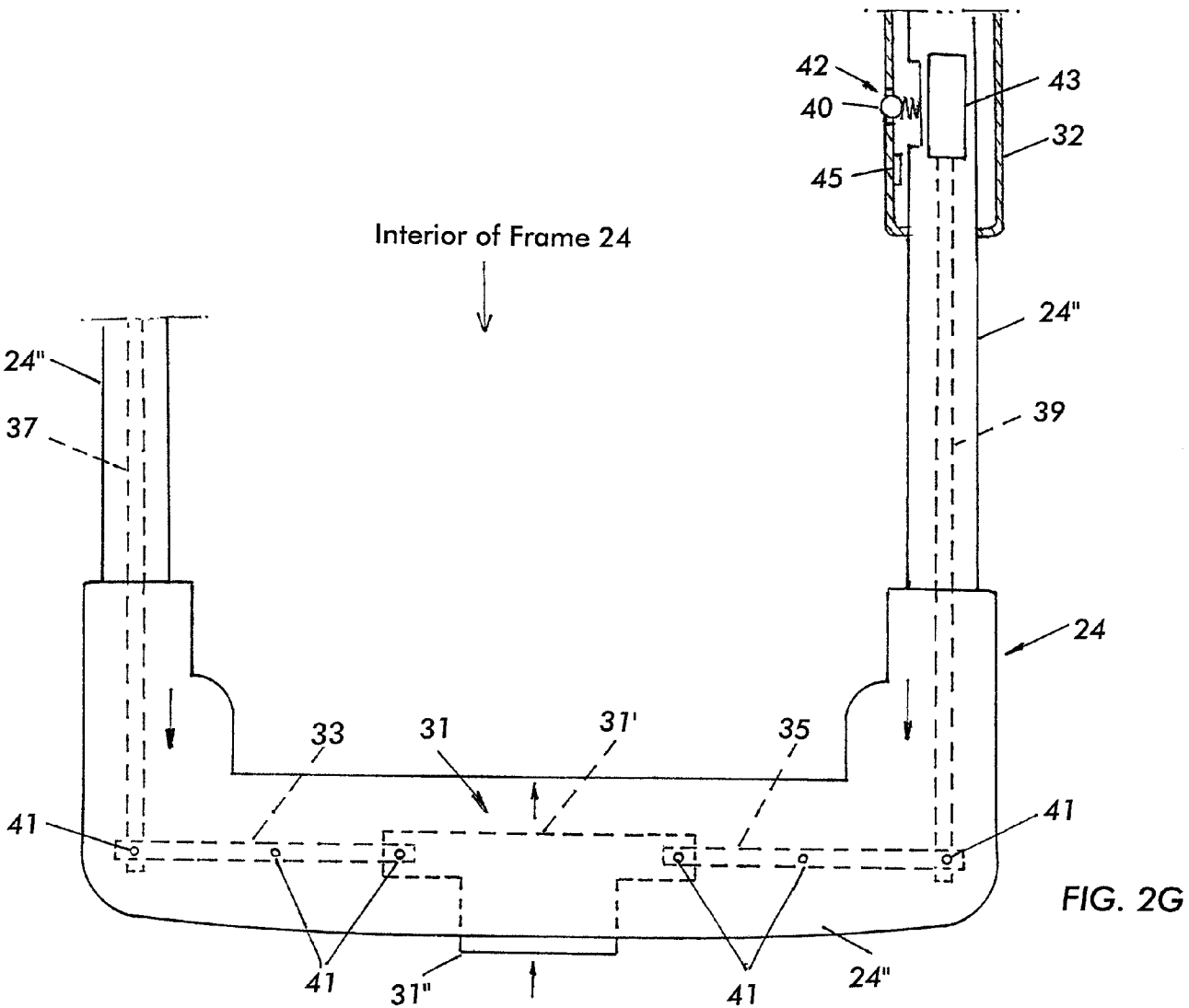
FIG. 2G illustrates a button operated, manual release mechanism for releasing two integrated catches in side legs of a frame of a support in a suitcase according to the present invention.
Figure 2H:
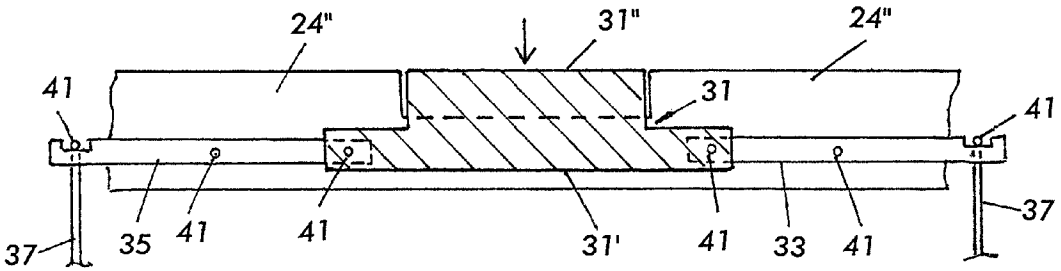
FIGS. 2H and 2I further illustrate the operation of a release mechanism according to FIG. 2G.
Figure 2I:
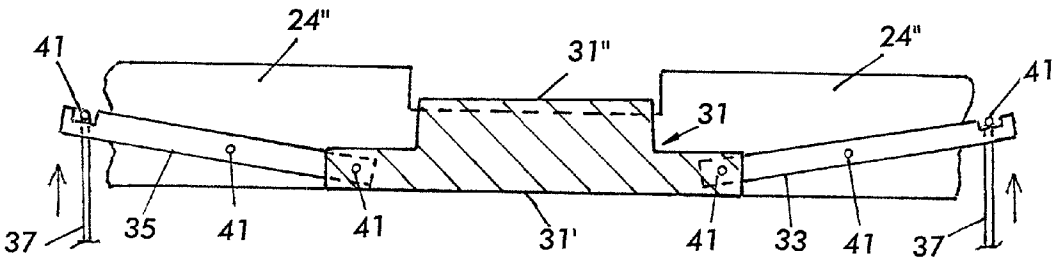

Referring now to FIGS. 2G-2I, a release mechanism may be provided to release catch 40 so that legs 24' may be inserted into supports 32. The release mechanism includes a button 31, which may be generally T-shaped, a first elongated transmission arm 33 and a second elongated transmission arm 35 each coupled to button 31, and a first elongated release arm 37 and second elongated release arm 39 each coupled to a respective elongated transmission arm 33, 35. T-shaped button 31 includes a narrow portion 31" coupled to the middle of a wide portion 31' to realize a T shape. Wide portion 31' is longitudinally aligned with the longitudinal axis of connector 24", and includes two terminal ends each connected by a pivot pin 41 to an end of an elongated transmission arm 33,35. Each transmission arm 33,35 is coupled by another pivot pin 41 at an opposite end thereof to an end of a respective release arm 37, 39, whereby the motion of each transmission arm 33, 35 can cause the motion of release arm 37, 39. The release mechanism is configured to allow a user to cause the release arms 37, 39 to move along an axis parallel to the longitudinal axis of a side leg 24'. Specifically, each transmission arm 33, 35 is pivotably coupled by a pivot pin 41 to connector 24" of frame 24 such that the motion of button 31 toward the interior of frame 24 causes release arms 39 to be directed in the opposite direction (see arrows). To realize this motion, each transmission arm 33, is coupled to connector 24" by a pivot pin 41. Note that only narrow portion 31" of button 31 may be accessible to a user, and the remaining parts may be disposed inside of connecter 24" and side legs 24' of frame 24.

Referring to FIG. 2G, each release arm 37, 39 includes an actuator 43 at an end thereof that is cooperatively coupled with the spring loaded catch 40 so that when release arm 39 is moved upon moving button 30, catch 40 can be withdrawn from opening 42, thus allowing side legs 24' to be inserted into support 32. Note that a stop 45 may be provided inside each support 32 to abut catch 40 and prevent legs 24' from being withdrawn completely from supports 32 in the event of misuse by the operator. Note that although only on arm 39 is illustrated, the other arm 37 will function in the same manner. Thus, a button 30 can cause the simultaneous operation of two arms 37,39.

Figure 2J:
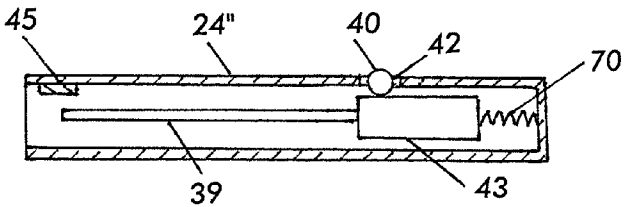
FIG. 2J illustrates an actuator mechanism for use with the release mechanism of the present invention.
Figure 2K:
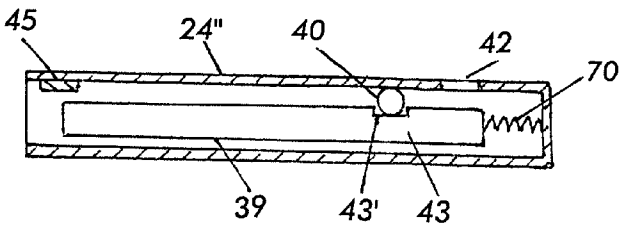
FIG. 2K illustrates another actuator mechanism for use with the release mechanism of the present invention.

Referring to FIG. 2J actuator 43 may be an enlarged body in which spring-loaded catch 40 resides. Thus, when release arm 39 is moved catch 40 is selectively moved to register with or deregister from opening 42. Alternatively, a cradle 43' may be defined in arm 39 (or 37) which is moved under ball catch 40 in order to effect release of catch 40 from opening 42. Note that optionally a spring 70 or the like body may be coupled to the end of arm 39 (and 37) and abutted against a surface for additional mechanical force. Also, a stop 45 may be provided in the interior of leg 24' to prevent the catch from falling out.

Figure 3A:
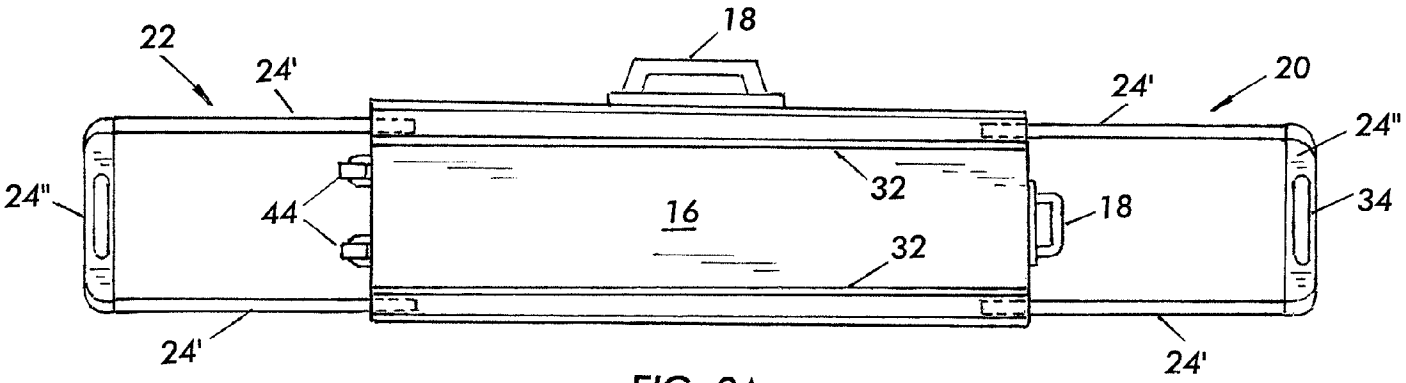
FIG. 3A shows a bottom plan view of another embodiment of a suitcase according to the present invention.

Referring to FIG. 3A, in another embodiment of the present invention, supports 32 can be attached to the exterior surface of base panel 16 of container section 12 instead of being disposed adjacent the interior surface of base panel 16, thus providing further space for storage of items. FIG. 3A further shows wheels 44 disposed on one of the short panels 12".

Figure 3B:
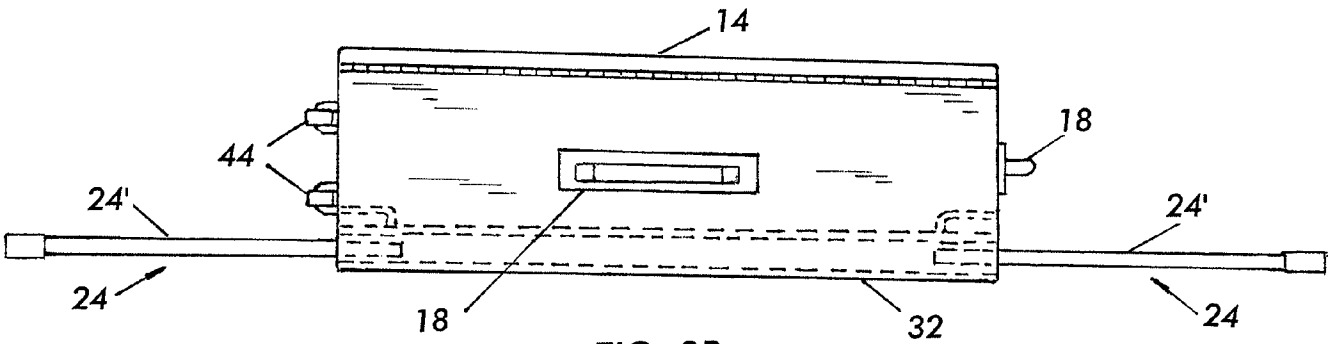
FIG. 3B shows a side plan view of the suitcase of FIG. 3A in one state (with the supports being deployed).
Figure 3C:
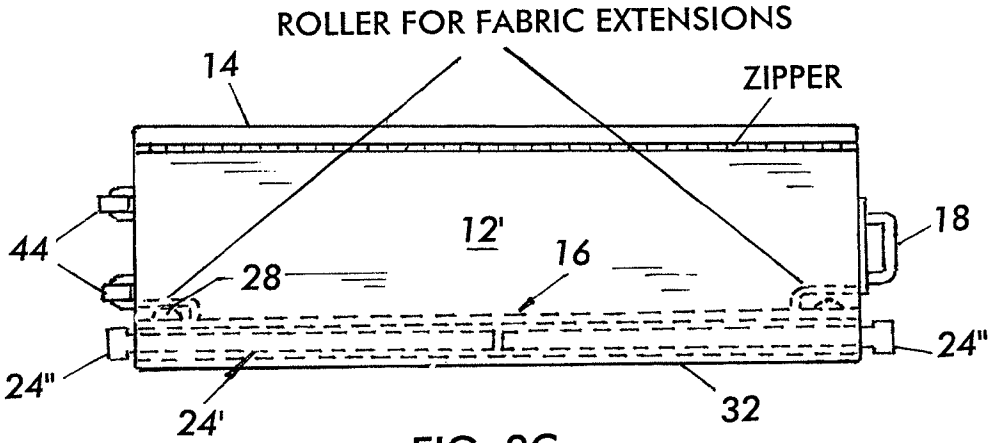
FIG. 3C shows a side plan view of a suitcase of FIG. 3A in another state (with the supports being in the stored state).
Figure 3D:
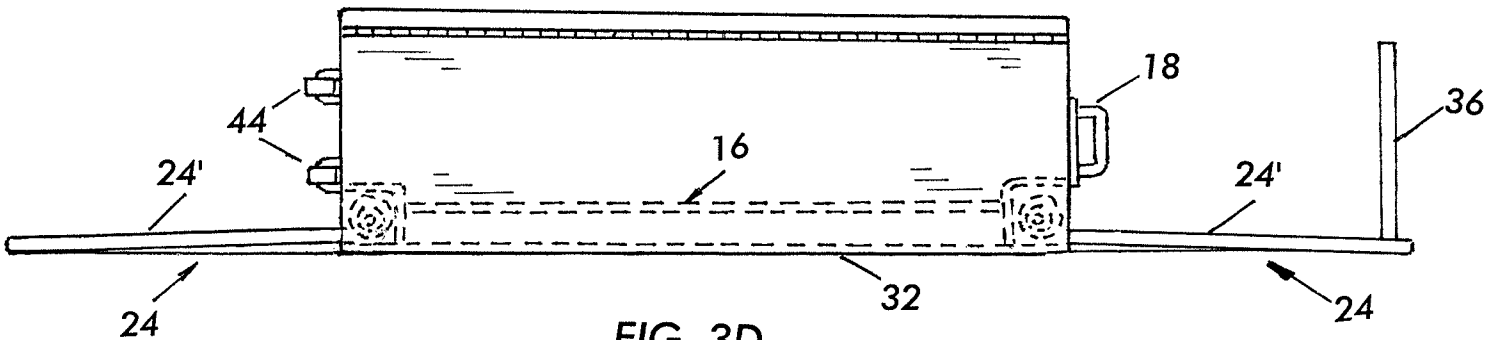
FIG. 3D shows a side plan view of the suitcase of FIG. 3A with the supports and a stabilizer deployed.

According to one aspect of the present invention, the provision of wheels 44 allows for the use of a connector 24" as a handle for pulling the suitcase. FIG. 3B illustrates a side plan view of the embodiment of FIG. 3A, with frames 24 in an extracted position. FIG. 3C illustrates a side plan view of the embodiment of FIG. 3A with legs 24' of frame 24 retracted inside support 32. FIG. 3D illustrates a side plan view of the embodiment of FIG. 3A with a stabilizer 36.

Figure 4A:
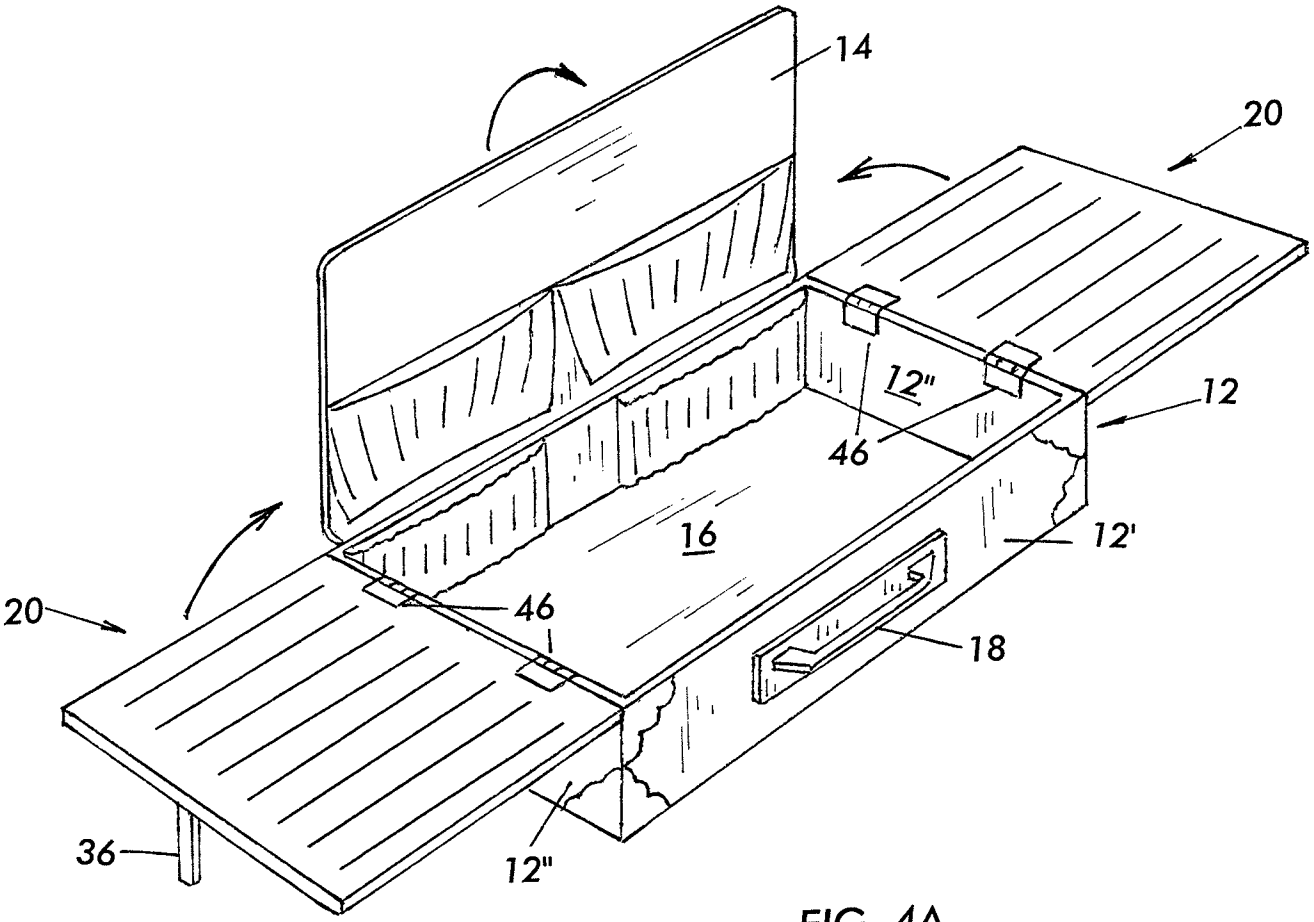
FIG. 4A shows a perspective view of a suitcase according to another embodiment of the present invention.
Figure 4B:
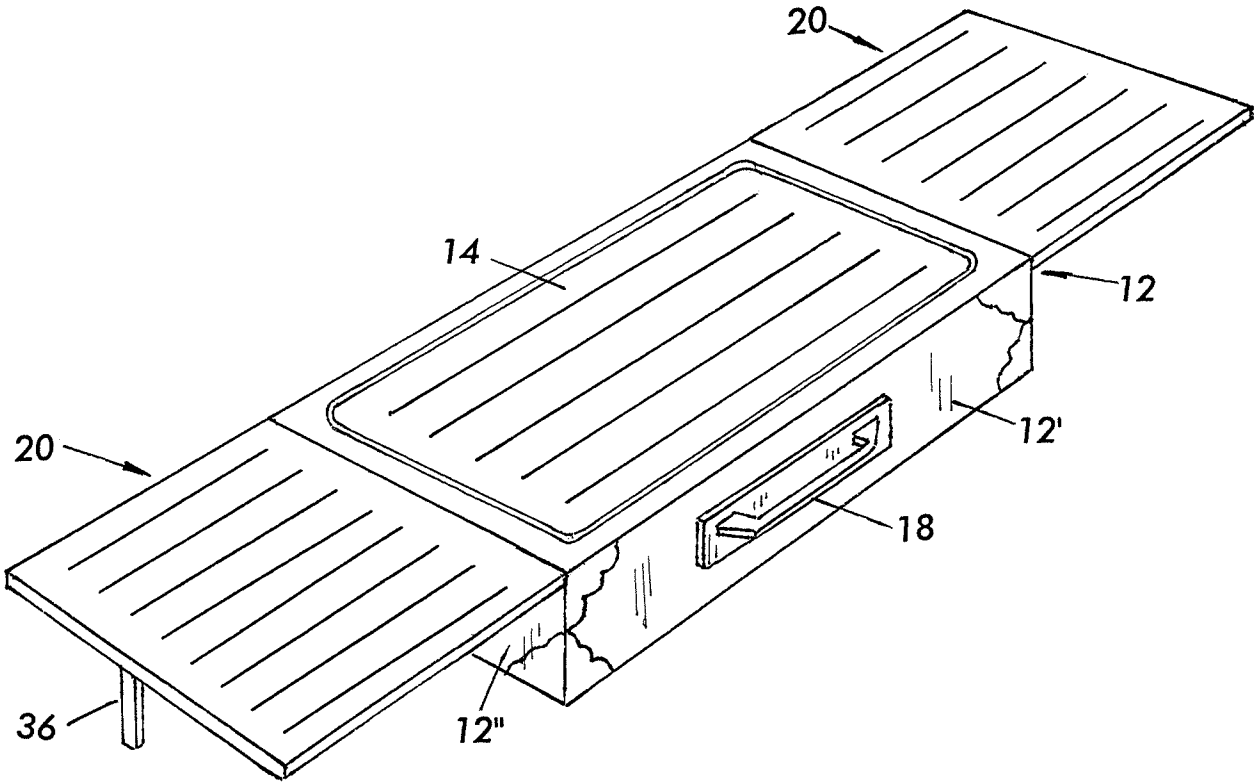
FIG. 4B shows a perspective view of the suitcase shown in FIG. 4A in a state ready for use.
Figure 5E:
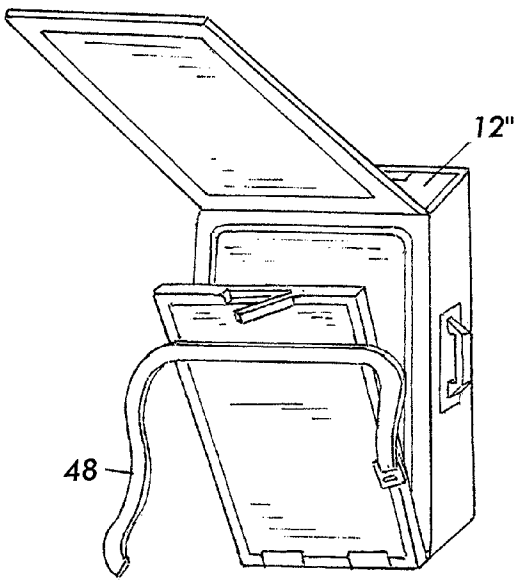
FIGS. 5A-5E illustrates a number of perspective views of another embodiment of the present invention.
Figure 5C:
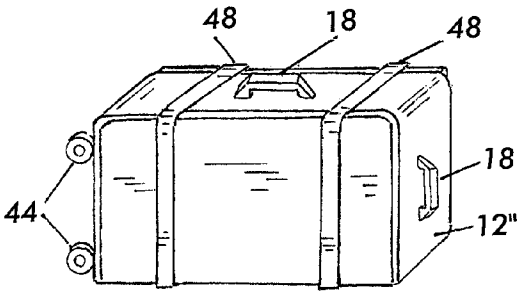
Figure 5D:
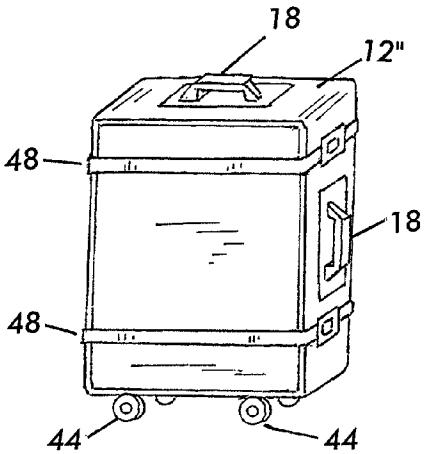
Figure 5A:
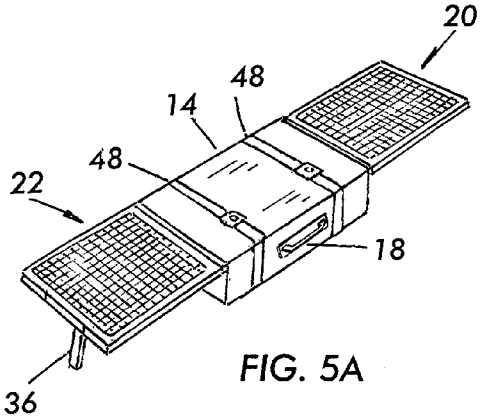
Figure 5B:
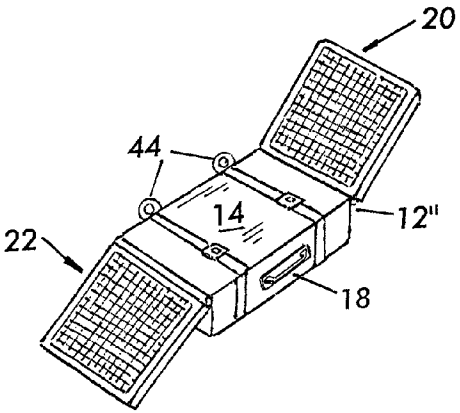

Referring to FIGS. 4A and 4B, in which like numerals identify like features, support arrangements 20, 22 may be rigid flat bodies that are coupled to short panels 12" of container section 12 by hinges 46 or the like devices. In this embodiment, the exterior section of top panel 14 (see FIG. 4B) may be used as part of the bed when supports 20, 22 are extended out to provide support points for a person lying down in the manner described above. Note that, in this embodiment, support arrangements 20, 22 may be received over the storage space of container section 12 below top panel 14 when not in use, but do not interfere with the storage space when extended for use as can be easily appreciated by an ordinary user. Further, note that each support in this embodiment, may include a stabilizer 36, one of which is illustrated. As in the other embodiments, if top panel 14 is made of a soft material (e.g., fabric), soft items (e.g., clothes) inside container 12 may provide the necessary support when the suitcase is converted into a bed.

FIGS. 5A-5E illustrate a plurality of views of a variation of the embodiment of FIGS. 4A and 4B. In this variation, supports 20, 22 are not positioned under top panel 14 when stored. Rather, support arrangements 20, 22 fold over the exterior surface of top panel 14 (or alternatively exterior surface of base panel 16) and are secured in place by straps 48 that are long enough to wrap around the suitcase. Support 20, 22 may be hingedly connected (e.g. using living hinges) to short panels 12' of container section 12. Support arrangements 20,22 in this variation may also include stabilizers.

Figure 6A:
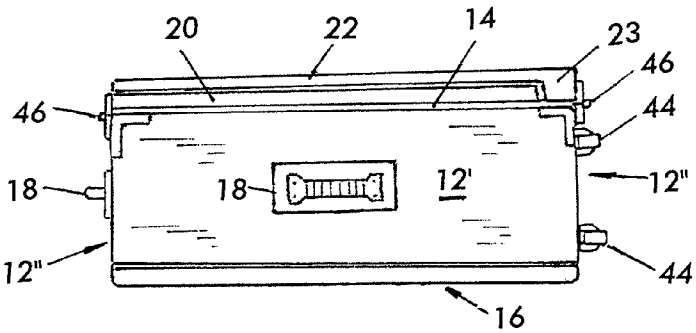
FIG. 6A shows a side plan view of a suitcase according to another embodiment of the present invention.

FIG. 6A illustrates a side plan view of a variation of an embodiment in which support arrangements 20, 22 are folded over top panel 14. In this variation, one support arrangement 20 is stored directly over top panel 14, and under the other support arrangement 22. Both support arrangements may be coupled to exterior surfaces of short panels 12" by hinges 46. Note that to fit snuggly between support 22 and top panel 14, support 22 is provided with a spacer section 23. Spacer section 23 abuts top panel 14 to provide a space between the bottom surface of support 22 and top panel 14 to accommodate support 20.

Figure 6B:
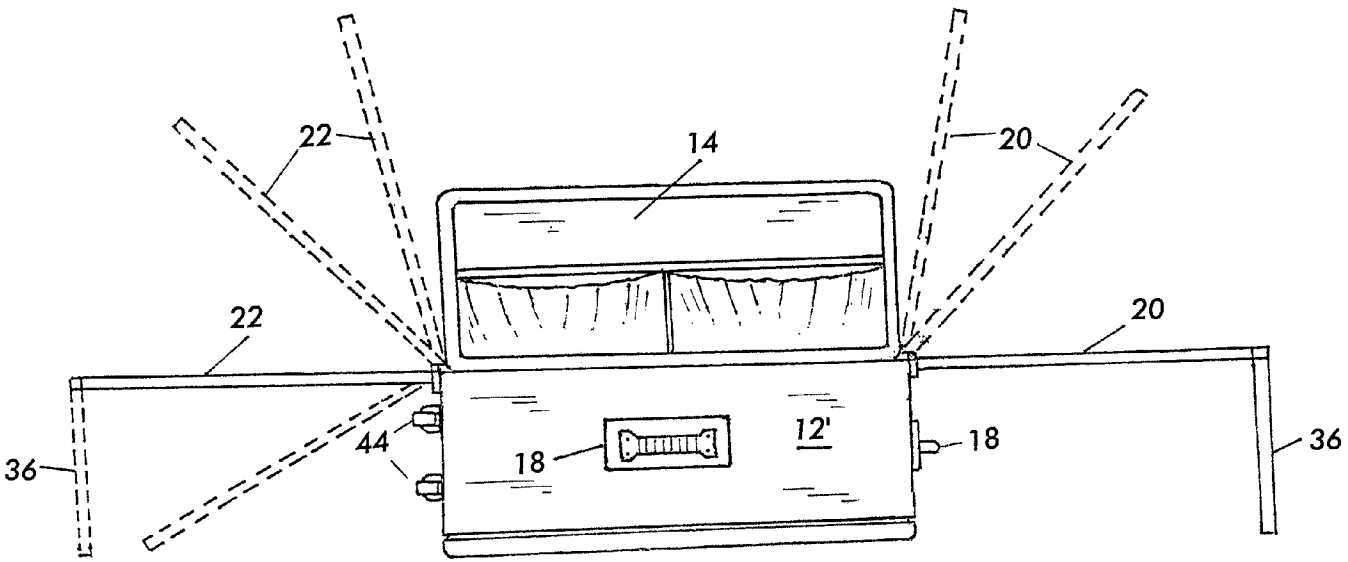
FIGS. 6B-6D illustrate various plan views of a suitcase as illustrated by FIG. 6A in different states of use.
Figure 6C:
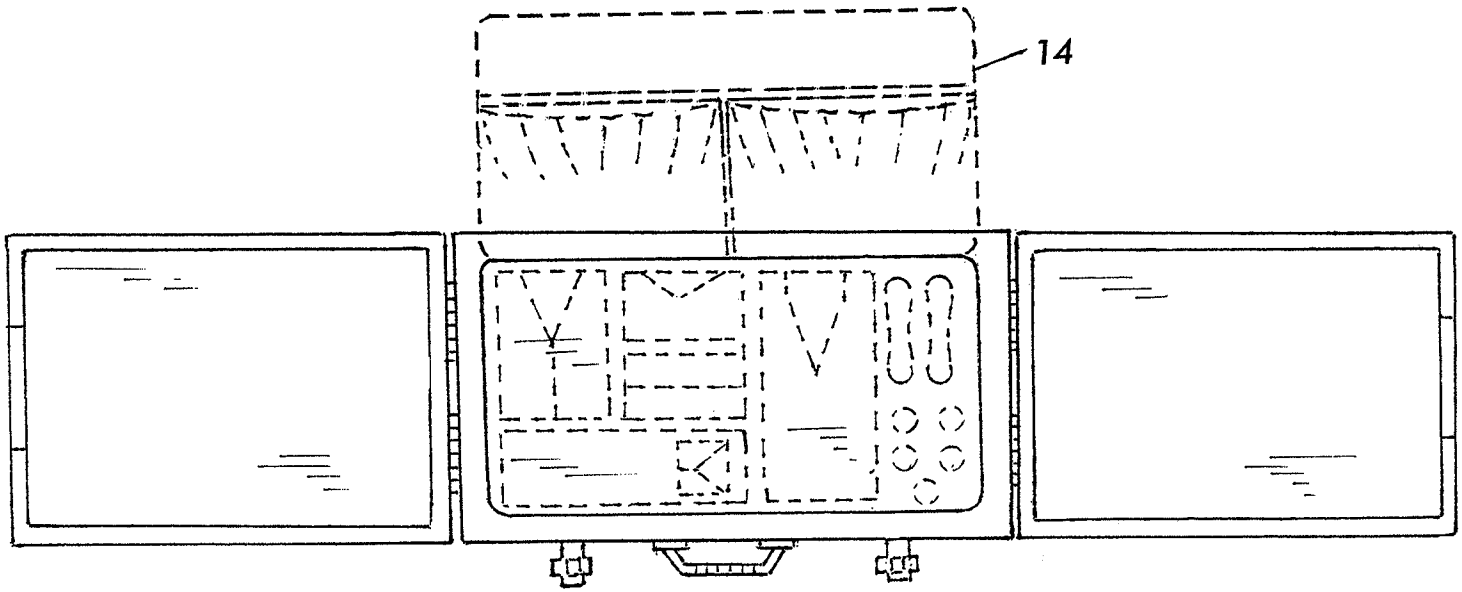
Figure 6D:
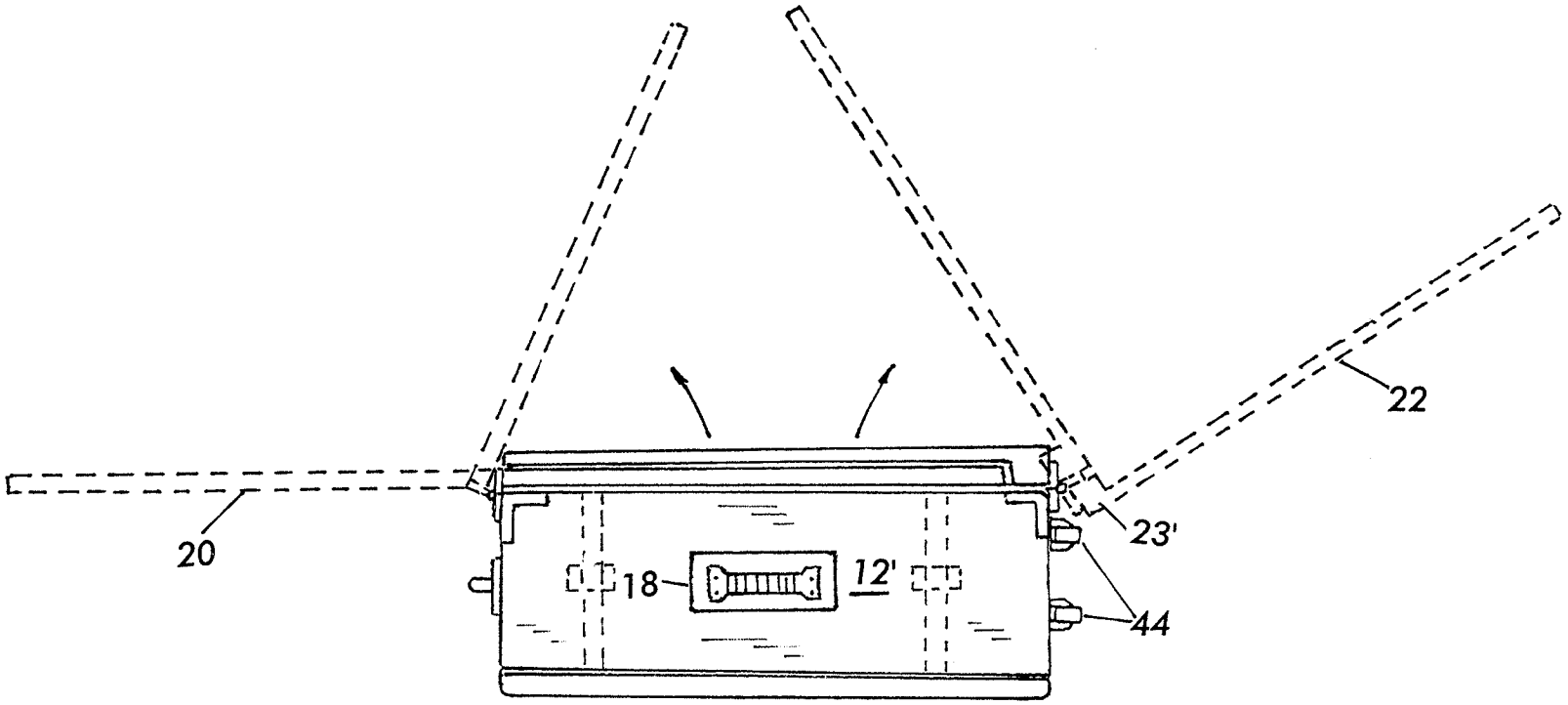

FIG. 6B shows a side plan view of the suitcase illustrated by FIG. 6A, in which support arrangements 20, 22 are deployed. FIG. 6C shows a top plan view of the suitcase of FIG. 6B. FIG. 6D illustrates schematically how support arrangements 20, 22 are deployed (the arrows illustrating rotation of supports 20, 22 about the axes of hinges 46).

Figure 7A:
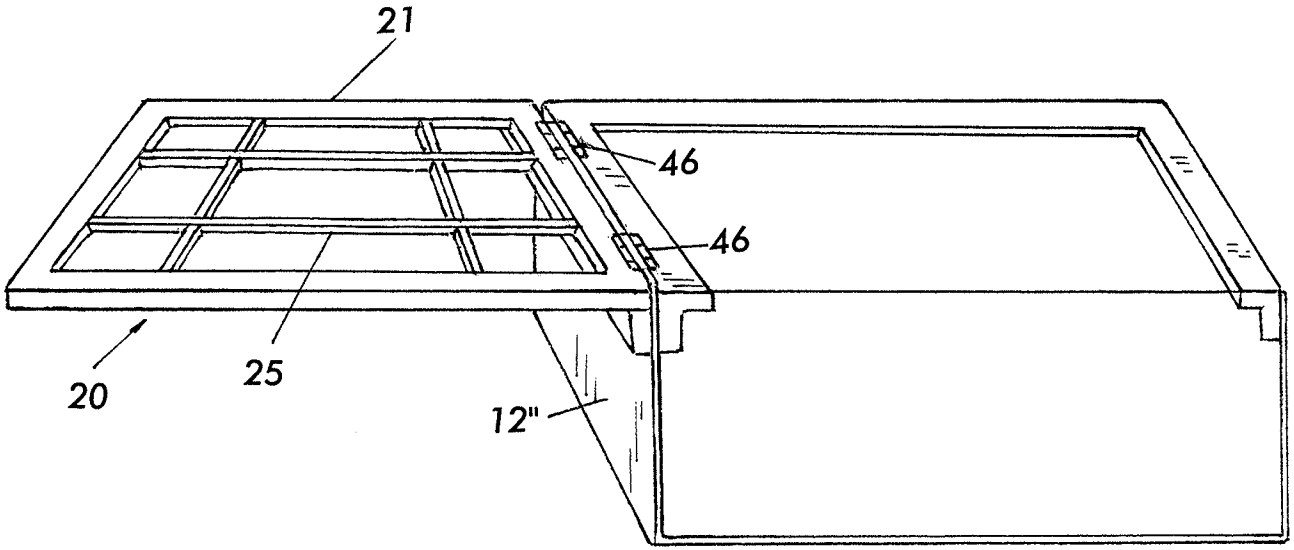
FIG. 7A illustrates a perspective view of another support arrangement for use with a suitcase according to the present invention.
Figure 7C:
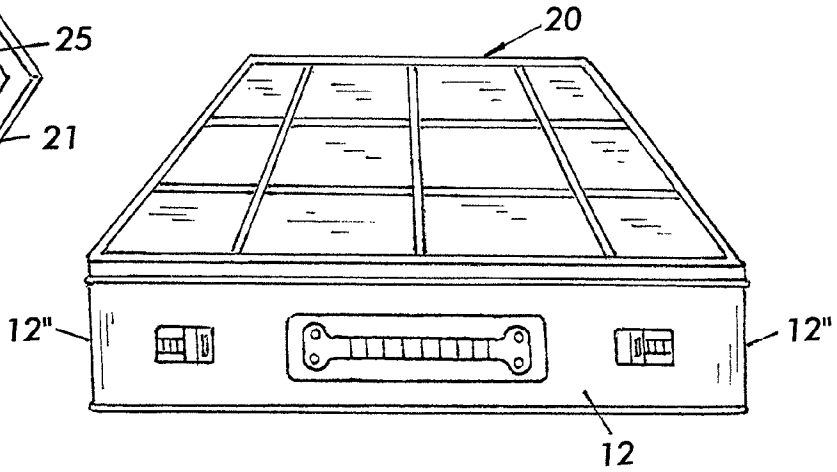
FIG. 7C illustrates a perspective view of a suitcase according to FIG. 7B with supports in an in operative state.
Figure 7B:
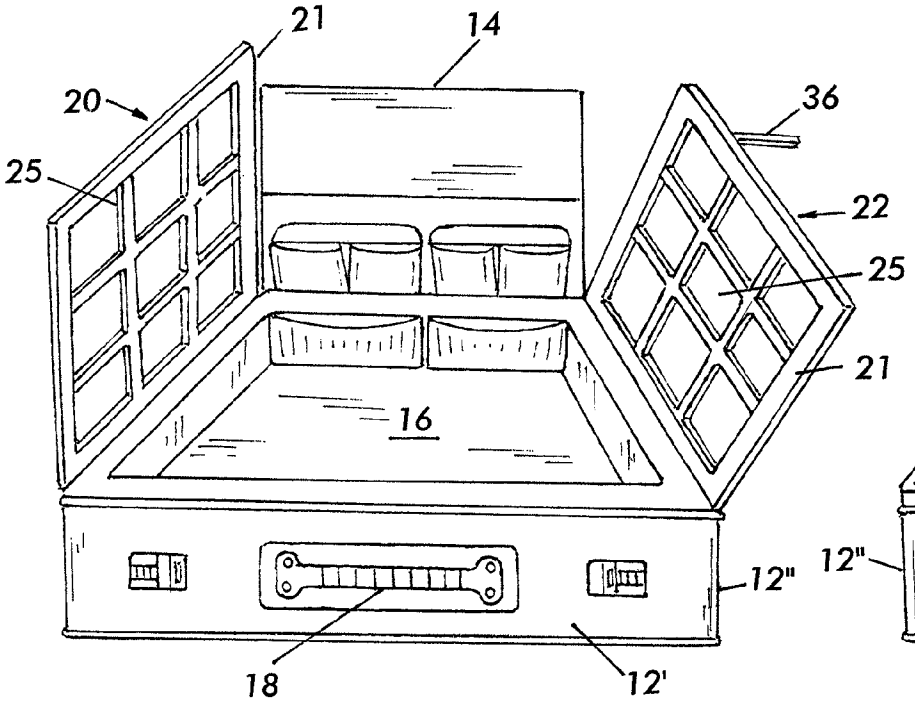
FIG. 7B illustrates a perspective view of a suitcase that includes supports according to the support illustrated by FIG. 7A.
Figure 8A:
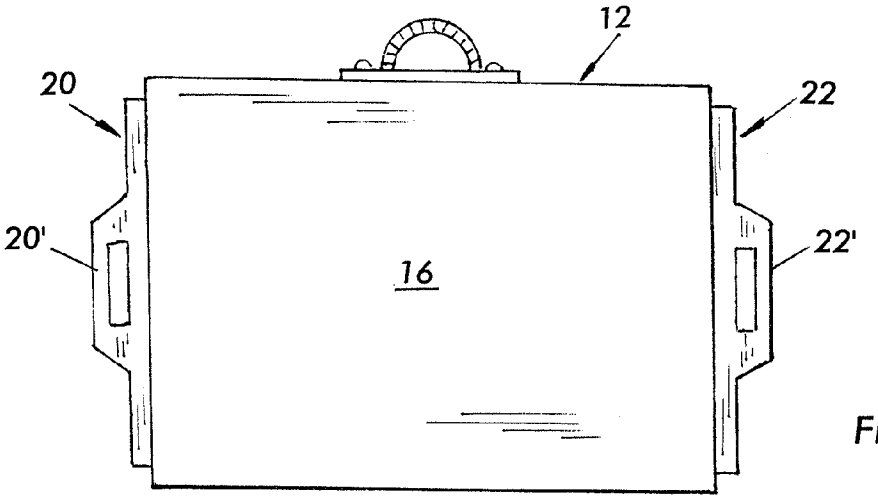
FIG. 8A shows a top plan view of a suitcase with integrated, retractable supports according to another embodiment of the present invention.
Figure 8B:
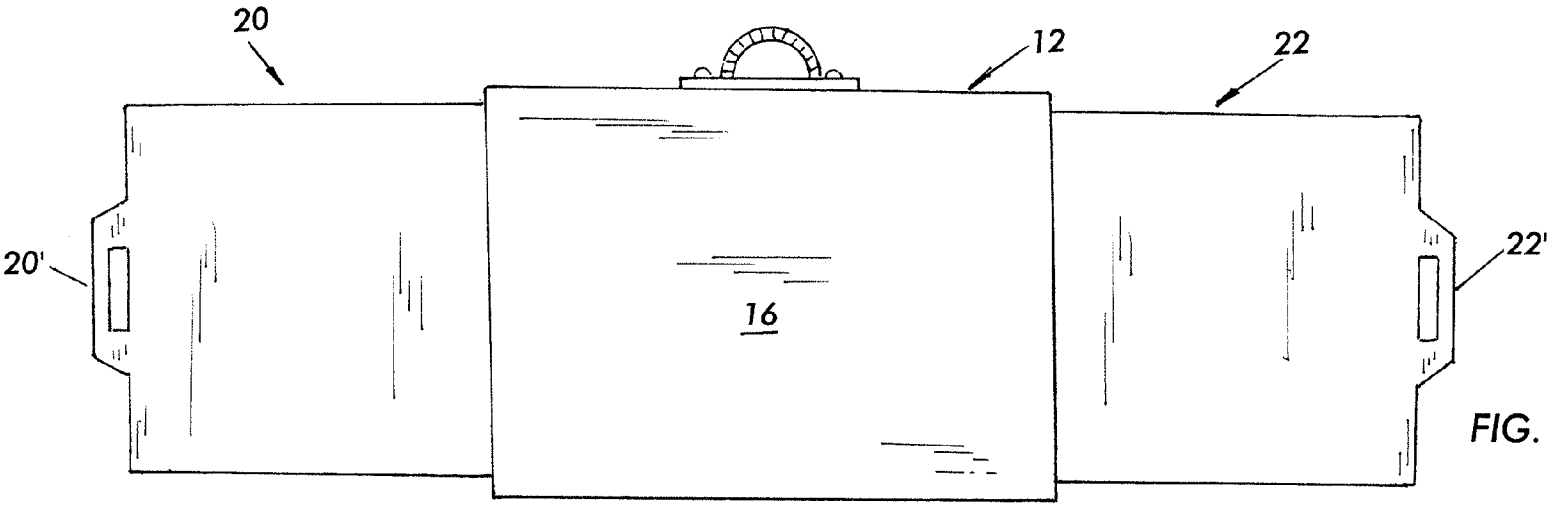
FIG. 8B shows a top plan view of the suitcase shown by FIG. 8A with the support sections thereof in an operative state.
Figure 8C:
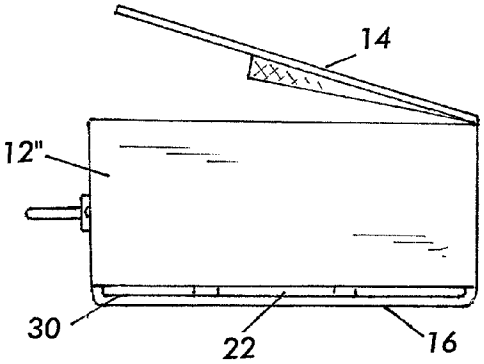
FIG. 8C illustrates a slot on a side of a suitcase according to the embodiment illustrated by FIG. 8A for receiving a support.
Figure 8D:
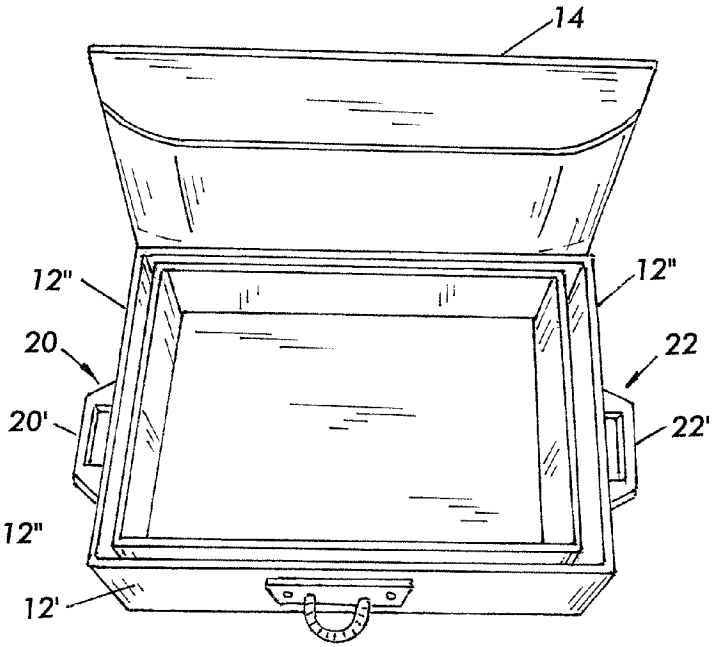
FIG. 8D illustrates a top view of the interior of a suitcase of the embodiment of FIG. 8A.

FIG. 7A illustrates a support arrangement 20, which includes an exterior closed frame 21 and a lattice 25 disposed inside and coupled to the interior of closed frame 21. The provision of a lattice 25 can provide enough mechanical support for the user, while further reducing the weight of support arrangement 20. A support arrangement 22 can be provided with the same features to further reduce the weight as illustrated by FIG. 7B. FIG. 7C illustrates that support arrangements 20, 22 as shown in FIGS. 7A and 7D can be folded over top panel 14 in the same manner as the embodiments of FIGS. 5, and 6A-6D.

Referring to FIGS. 8A-8D, a suitcase according to another embodiment may include support arrangements 20, 22, that are flat and relatively rigid, and slide out from the interior of container section 12 through slots 30 defined between side walls 12" and base panel 16. Support arrangements 20, 22 may be provided with handle sections 20', 22' to facilitate the manipulation thereof.

Figures 9A, 9B:
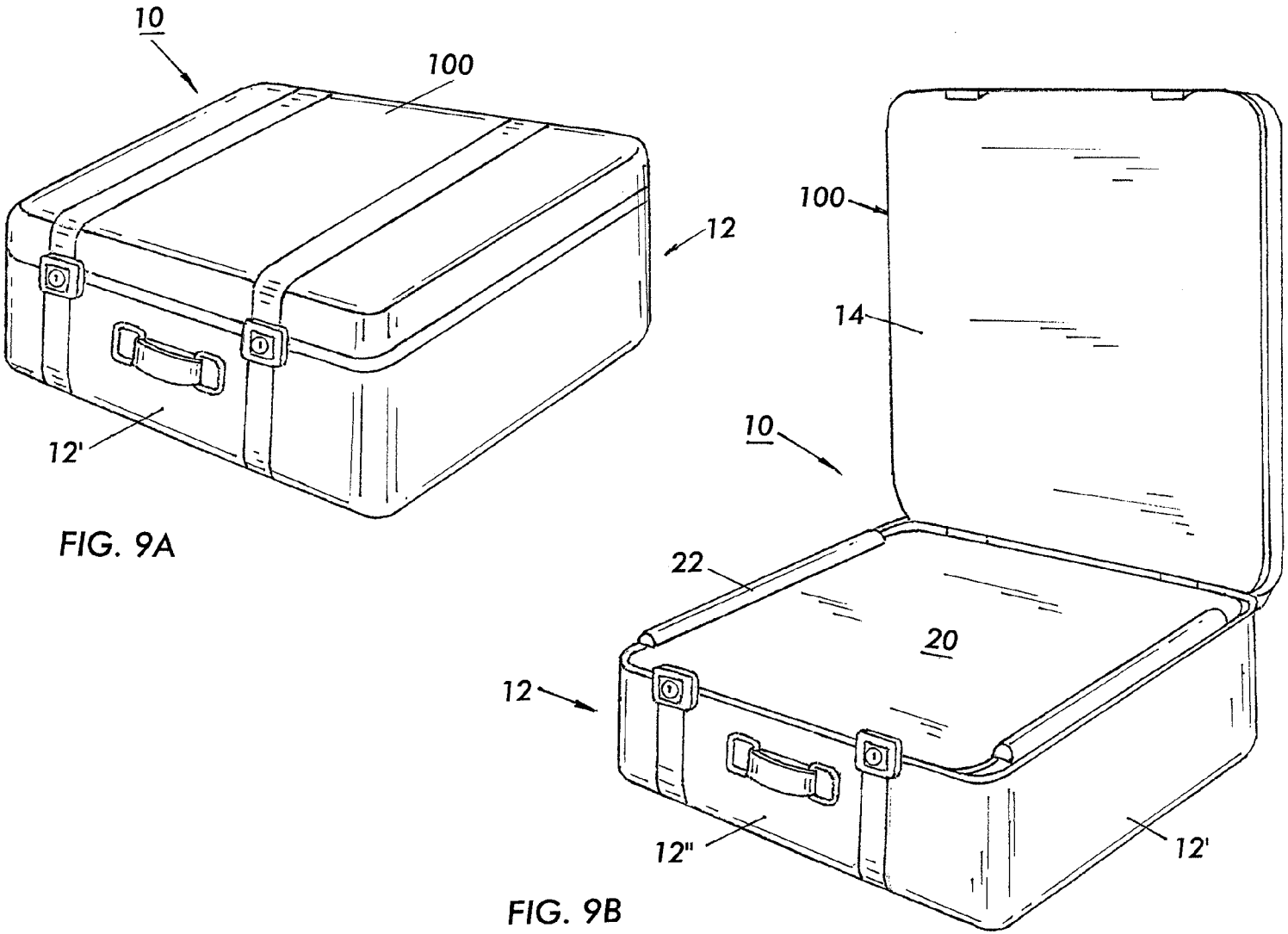
FIG. 9A-9G illustrate another embodiment of an apparatus according to the present invention.

FIG. 9A illustrates a perspective view of an apparatus according to another embodiment of the present invention. In this embodiment, top panel 14 does not include a surface that coincides with the exterior, top surface of suitcase 10. Rather, in this embodiment top panel 14 is hidden inside a cover section 100. Cover section 100 cooperates to enclose hidden top panel 14, and support arrangements 20, 22 in a space above the storage space of container section 12.

FIG. 9B illustrates the embodiment of FIG. 9A with a cover section 100 thereof open. As illustrated, hidden top panel 100 is received inside cover section 100. FIG. 9B further illustrates support arrangements 20, 22 in a stored state. Note that in this embodiment support arrangements 20, 22 overlap one another. When cover section 100 is closed, hidden top panel 14 also overlaps support arrangements 20, 22.

Figure 9C:
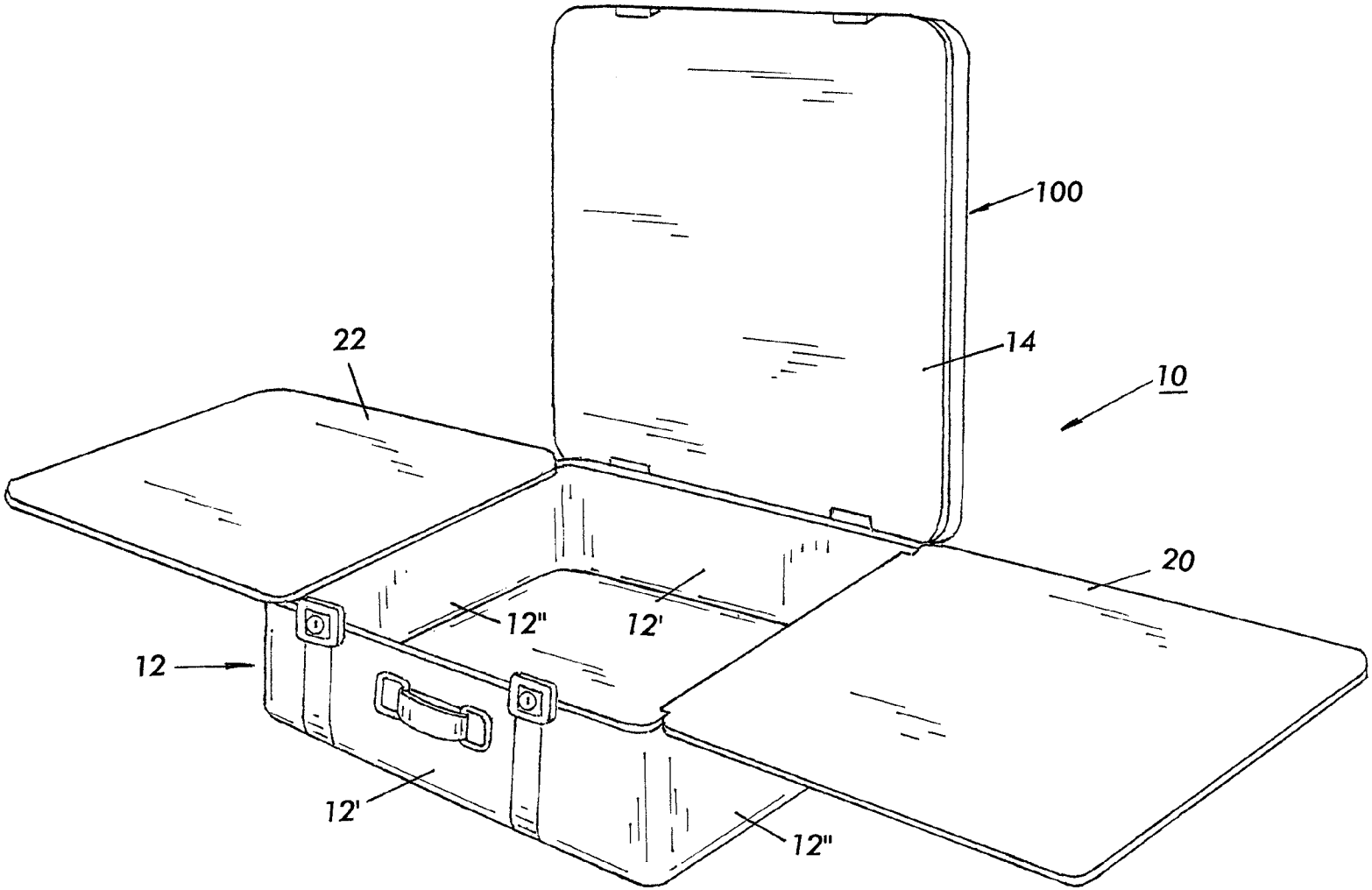

FIG. 9C illustrates the embodiment of FIG. 9A with support arrangements 20, 22 in an extended state. Support arrangements 20, 22 may be rigid flat bodies which are rotatably coupled to respective sides of container section 12 (e.g. interior edges of short sides 12"). A hinge or the like feature may be used to rotatably couple each support arrangement 20, 22 to a side of container section 12.

Figure 9D:
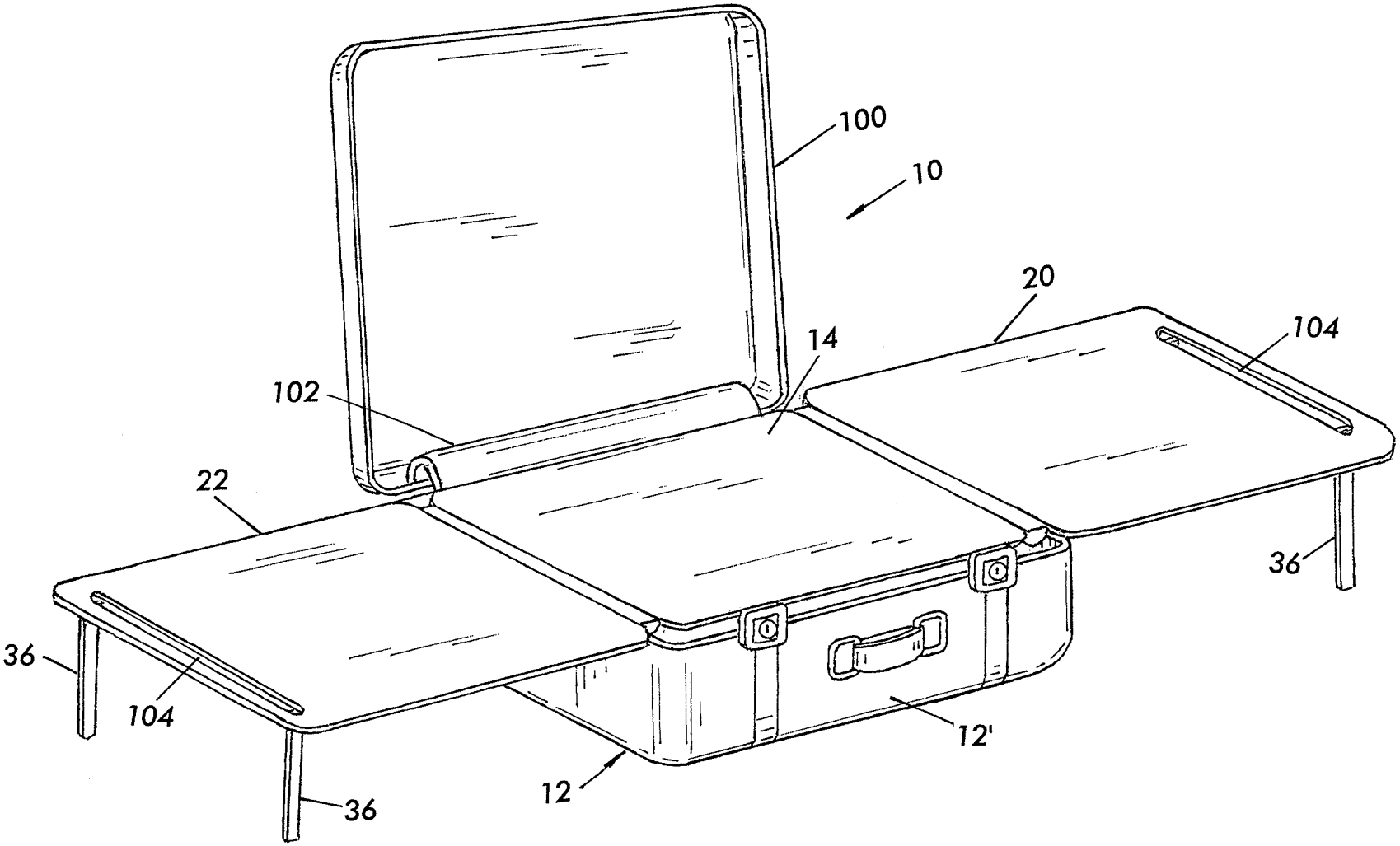
Figure 9G:
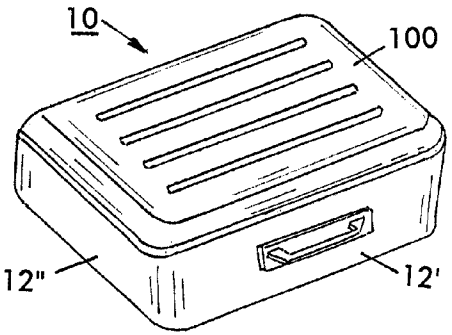
Figure 9F:
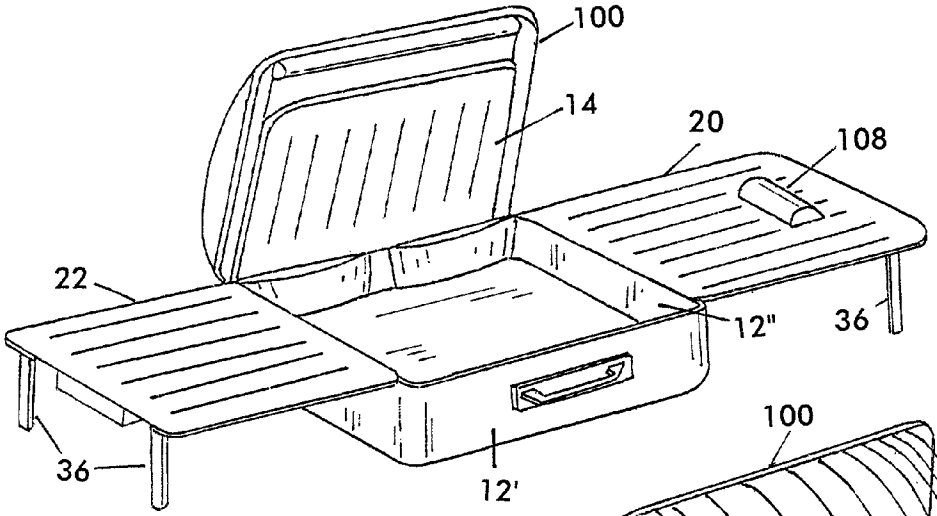

Referring to FIG. 9D, once support arrangements 20, 22 are deployed and are in an extended state, hidden top panel 14 is moved to a position over the storage space of container section 12 and between support arrangements 20, 22 to provide a platform that can serve as a bed or the like for a person in a lying position. Note that a living hinge 102 can couple hidden top panel 14 to the interior surface of cover section 100. Thus, hidden top panel 14 can also be rotatably moved into and out of cover section 102. Further note that in this embodiment, two spaced stabilizers 36 can be integrated with each support arrangement 20, 22. Each stabilizer 36 in this embodiment may be rotatably coupled (by a pivot pin or the like) to the support arrangement 20, 22 and rotated into a recess for storage.

Figure 9E:
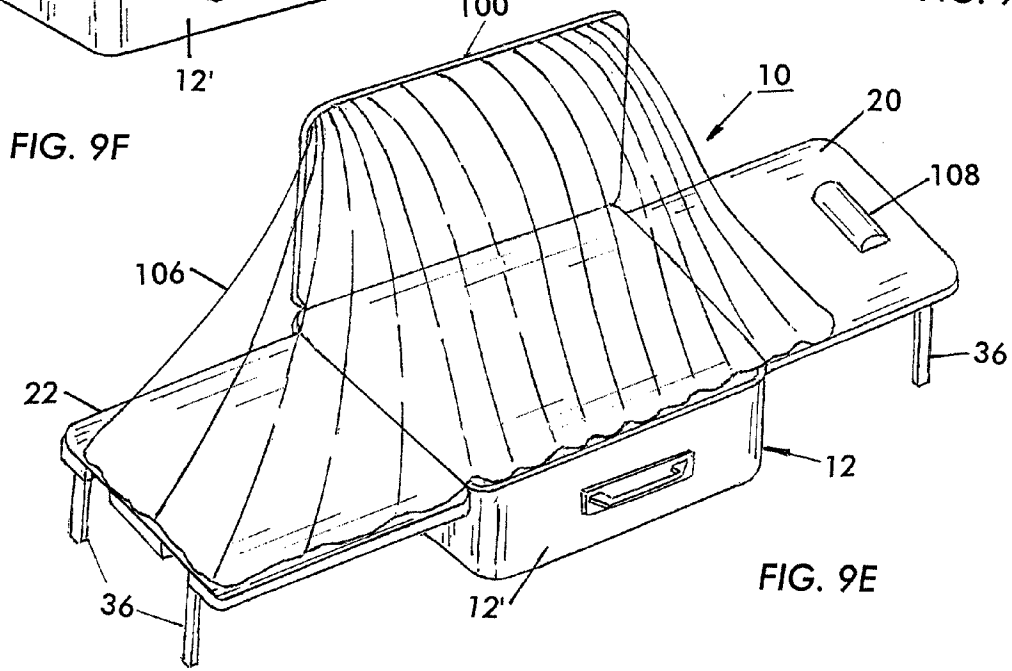

FIG. 9E illustrates that optionally a covering like a curtain 106 can be integrated into cover section 100 and deployed for the user's privacy when needed. In this figure a headrest 108 that is integrated with one of the support arrangements 20 is also shown. FIGS. 9E (open with extended support arrangements 20, 22) and 9G (closed position) are further views of the embodiment.

As can be appreciated by a skilled person, an apparatus according to the present invention advantageously embodies the following features. These features are present in every embodiment disclosed herein.

Support arrangements 20,22 can be deployed and stored without having any part thereof interfering (i.e. crossing or passing through) the storage space of container section 12. Thus, a user can conveniently make use of the support mechanisms of the present invention without the need to remove the items contained in the storage space of container section 12.

Moreover, when deployed (i.e. extended state) at least one support arrangement 20,22 (and preferably both support arrangements 20,22) will include a region on a support surface thereof (e.g. a portion on a sheet 26 or a portion on the rigid bodies serving as support arrangements 20,22) that intercepts a horizontal plane coinciding and coplanar with a region of the exterior surface of base panel 16 or top panel 14. Consequently, the mid section of a person can be supported by a region coinciding and coplanar with the exterior surface of a base panel 16 or top panel 14 while the upper section of the person can be supported by the region on a support surface that intercepts a horizontal plane coinciding and coplanar with the exterior surface of base panel 16 or top panel 14, whereby the body of the person lying down is not forced into an arched position. Rather, the body of the person lying down will find a support position for its mid section on a horizontal plane that coincides and is coplanar with a region on the exterior surface of base panel 16 or top panel and another support position for its upper section on a surface of a support arrangement 20,22. The distance between these two support positions can be determined statistically for a commercial embodiment of the present invention. Preferably, this distance will not be less than two feet. Note that the same support configuration can be provided to support the mid section and the lower section of a person lying down, whereby the body of a person lying down can be supported by three support points on a horizontal plane that coincides and is coplanar with a region on base panel 16 or top panel 14, is intercepted by a support surface in one support arrangement 20,22, and intercepted by a support surface of the other support arrangement 20,22. The appropriate distances between the support points can be determined statistically.

As is apparent from the figures, the support arrangements are wider than the width of side panels 12',12" to provide adequate surface area to support the width of a human body lying down on his/her back. This width should be taken in a direction transverse to the direction of extension of support arrangements and can also be calculated statistically. Preferably, the width is not less than eighteen inches.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. An apparatus comprising:

a suitcase that includes a container section having a base panel, a top panel spaced from said base panel, and a plurality of side panels extending from said base panel around a storage space for receiving items disposed between said top panel and said base panel, said base panel and said top panels having a width and a length, and each said side panel having a width, which is shorter than the length and the width of said base and top panels;

a first support arrangement residing at one side of said suitcase and is selectively transformable from an extended state to a stored state and from a stored state to an extended state without interfering with said storage space; and a second support arrangement residing at another side of said suitcase opposite said one side and is selectively transformable from an extended state to a stored state and from a stored state to an extended state without interfering with said storage space;

wherein each said support arrangement comprises a frame that includes two spaced elongated legs that are connected to one another by a connector and a compliant body that is detachably connectable to said connector; and further comprising a roller mechanism associated with each compliant body, each roller mechanism including a roller body, wherein each said compliant body is rolled around said roller body in said stored state; wherein said roller mechanism is adjacent said storage space and includes a housing element that separates said roller mechanism from said storage space, and wherein each said compliant body is accessible and retractable from said storage space through a respective slot.

2. The apparatus of claim 1, further comprising a first longitudinally extending support and a second longitudinally extending support, each having two opposite open ends leading into a hollow interior, wherein each longitudinally extending support receives in said interior thereof a respective leg of a frame from one end thereof.

3. The apparatus of claim 1, further comprising a first longitudinally extending support and a second longitudinally extending support, each having two opposite open ends leading into a hollow interior, wherein each longitudinally extending support receives in said interior thereof a respective leg of a frame from one end thereof, and wherein said legs of said first support is receivable in the interior of said legs of said second support.

4. The apparatus of claim 1, wherein each said slot is located between one of said side panels and a base panel.

5. The apparatus of claim 4, wherein each said roller is located inside said storage space closer to said base panel than said top panel.

6. The apparatus of claim 4, wherein each said roller is located closer to said base panel than said top panel.

7. The apparatus of claim 4, wherein said support arrangement, in its extended state, provides support and is located at a side of said base panel.

8. The apparatus of claim 1, wherein each said support arrangement, in its extended state, provides support and is located at a respective side of said base panel.

9. An apparatus comprising:

a suitcase that includes a container section having a base panel, a top panel spaced from said base panel, and a plurality of side panels extending from said base panel and disposed around a storage space for receiving items disposed between said top panel and said base panel; and at least one support mechanism residing at one side of said suitcase that includes in an extended state a support surface, said at least one support mechanism being configured for change from said extended state to a stored state without interfering with said storage space;

wherein said support mechanism comprises a frame that includes two spaced elongated legs extendable from inside said suitcase, said legs are connected to one another by a connector and a compliant body that is detachably connectable to said connector, and further comprising a roller mechanism associated with said compliant body, said roller mechanism including a roller body, wherein said compliant body is rolled around said roller body in said stored state; wherein said roller mechanism is adjacent said storage space and includes a housing element that separates said roller mechanism from said storage space, and wherein said compliant body is accessible and retractable from said storage space through a slot.

10. The apparatus of claim 9, further comprising another support mechanism residing at another side of said suitcase opposite said one side, said at least one support mechanism being configured for change from said extended state to a stored state without interfering with said storage space.

11. The apparatus of claim 10, further comprising a first longitudinally extending support and a second longitudinally extending support, each having two opposite open ends leading into a hollow interior, wherein each longitudinally extending support receives in said interior thereof a respective leg of a frame from one end thereof, and wherein said legs of said first support is receivable in the interior of said legs of said second support.

12. The apparatus of claim 9, further comprising a first longitudinally extending support and a second longitudinally extending support, each having an open end leading into a hollow interior, wherein each longitudinally extending support receives in said interior thereof a respective leg of a frame from the open end thereof.

13. The apparatus of claim 9, wherein said compliant body is retractable by said roller mechanism through a slot defined in one of said panels.

14. The apparatus of claim 9, wherein said compliant body is retractable by said roller mechanism through the slot.

15. The apparatus of claim 9, wherein said first and second longitudinally extending supports reside on a surface of said base panel.

16. The apparatus of claim 9, wherein said first and second longitudinally extending supports reside on an interior surface of said base panel.

17. The apparatus of claim 9, wherein said slot is located between one of said side panels and a base panel.

* * * * *